US009930955B2

(12) United States Patent
Nielsen

(10) Patent No.: US 9,930,955 B2
(45) Date of Patent: Apr. 3, 2018

(54) STRAP LIFTER FOR USE BETWEEN TWO PERSONS WITH MULTIPLE LIFTING OPTIONS

(71) Applicant: Corey David Nielsen, Longmont, CO (US)

(72) Inventor: Corey David Nielsen, Longmont, CO (US)

( * ) Notice: Subject to any disclaimer, the term of this patent is extended or adjusted under 35 U.S.C. 154(b) by 0 days.

(21) Appl. No.: 15/013,960

(22) Filed: Feb. 2, 2016

(65) Prior Publication Data

US 2017/0215560 A1 Aug. 3, 2017

(51) Int. Cl.
*A45F 3/14* (2006.01)

(52) U.S. Cl.
CPC ..... *A45F 3/14* (2013.01); *A45F 2003/142* (2013.01); *A45F 2003/144* (2013.01); *A45F 2003/146* (2013.01)

(58) Field of Classification Search
CPC ..... A45F 3/14; A45F 2003/142; A45F 2003/144; A45F 2003/146
USPC ..... 224/259
See application file for complete search history.

(56) References Cited

U.S. PATENT DOCUMENTS 356,846 A * 2/1887 Martin ..... B63H 16/06 224/222
1,535,208 A 4/1925 Drennan
1,611,588 A 12/1926 Hyde
1,879,480 A * 9/1932 Pures ..... A45F 3/14 224/260
1,995,439 A 3/1935 Tompkins
2,099,387 A 11/1937 Cohn et al.
2,431,780 A 12/1947 Theal
2,528,078 A 10/1950 Quilter
2,718,988 A * 9/1955 Potts ..... A45F 5/00 224/231
2,743,497 A 5/1956 Davis
3,293,713 A 12/1966 Gaylord
(Continued)

FOREIGN PATENT DOCUMENTS

WO 2012154702 A2 11/2012

OTHER PUBLICATIONS

Shoulder Dolly, Moving Straps—Easier Than a Moving Dolly, http://shoulderdolly.com/, available at least as early as Dec. 2, 2010, pp. 1-2.

(Continued)

*Primary Examiner* — Peter Helvey
(74) *Attorney, Agent, or Firm* — Pedersen and Company, PLLC; Ken J. Pedersen; Barbara S. Pedersen

(57) ABSTRACT

A lifter system includes a harness, at least one lifting strap carried by a front, central buckle on the harness, and two arm loops connected to the central buckle or to the harness near the central buckle. The arm loops are used to supply supplemental or substitute lifting force during lifting or maneuvering a heavy or bulky object. Preferably, a set of two shoulder harnesses is used by two persons standing face-to-face with a single lifter strap between them threaded through both of the central buckles, wherein the two persons wear the arm loops on their forearms and raise their arms to lift the central buckles, and hence, to lift the lifting strap, to levels higher than may be possible with only force supplied by the harnesses.

15 Claims, 29 Drawing Sheets

(56) References Cited

U.S. PATENT DOCUMENTS

| | | | | |
|---|---|---|---|---|
| 4,280,645 | A * | 7/1981 | Goodden | A45F 3/14 224/259 |
| 5,009,349 | A * | 4/1991 | Eide | A45F 5/00 224/260 |
| 5,307,967 | A | 5/1994 | Seals | |
| 5,497,923 | A | 3/1996 | Pearson et al. | |
| 5,588,940 | A | 12/1996 | Price et al. | |
| 6,006,970 | A * | 12/1999 | Piatt | A45F 3/14 224/257 |
| 6,039,376 | A | 3/2000 | Lopreiato | |
| 6,213,365 | B1 | 4/2001 | Stocke et al. | |
| 6,508,389 | B1 | 1/2003 | Ripoyla et al. | |
| 6,641,008 | B2 | 11/2003 | Falzone et al. | |
| 6,679,404 | B2 | 1/2004 | Brandt | |
| 6,698,632 | B1 | 3/2004 | Turner et al. | |
| 6,729,511 | B2 | 5/2004 | Dent | |
| 7,331,493 | B2 | 2/2008 | Dent | |
| 7,731,069 | B2 | 6/2010 | Lopreiato | |
| 8,657,166 | B1 * | 2/2014 | Harness | A45F 5/021 224/259 |
| 8,807,403 | B2 | 8/2014 | Nielsen | |
| 9,101,202 | B2 | 8/2015 | Nielsen | |
| 2002/0148866 | A1 | 10/2002 | Dent | |
| 2005/0263551 | A1 | 12/2005 | Dent | |
| 2005/0279791 | A1 * | 12/2005 | Komorowski | A45C 13/38 224/260 |
| 2007/0131726 | A1 | 6/2007 | Aliev | |
| 2007/0187445 | A1 | 8/2007 | Krapka | |
| 2012/0145756 | A1 | 6/2012 | Fuller et al. | |
| 2016/0183665 | A1 | 6/2016 | Nielsen | |

OTHER PUBLICATIONS

Shoulder Dolly, Products, http://shoulderdolly,com/products-2/, available at least as early as Dec. 2, 2010.

Forearm Forklift Lifting Straps®, http://www.forearmforklift.com/ForearmForkliftLiftingStraps.html, Jun. 22, 2015.

Moving Harness, http://www.forearmforklift.com/MovingHarness.html, Jun. 22, 2015.

Extension Strap, http://www.forearmforklift.com/ExtentionStrap.html, Aug. 4, 2015.

PCT International Search Report and the Written Opinion, Dec. 18, 2012, PCT/US2012/036855, Applicant: Nielsen.

Chinese Examiner's Action (and English Translation), Chinese Patent Application No. 201280022103.7, National Entry of PCT/US2012/036885, Applicant: Corey D. Nielsen.

European Examiner's Action, European Patent Application No. 12781609.8, National Entry of PCT/US2012/036855, Aug. 14, 2015, Applicant: Corey D. Nielsen.

European Search Report, in related Application No. EP 17 15 2941, Applicant: Nielsen, dated: May 18, 2017.

Eurasian Search Report, in related Application No. 201790113, Applicant: Nielsen, Jun. 7, 2017.

* cited by examiner

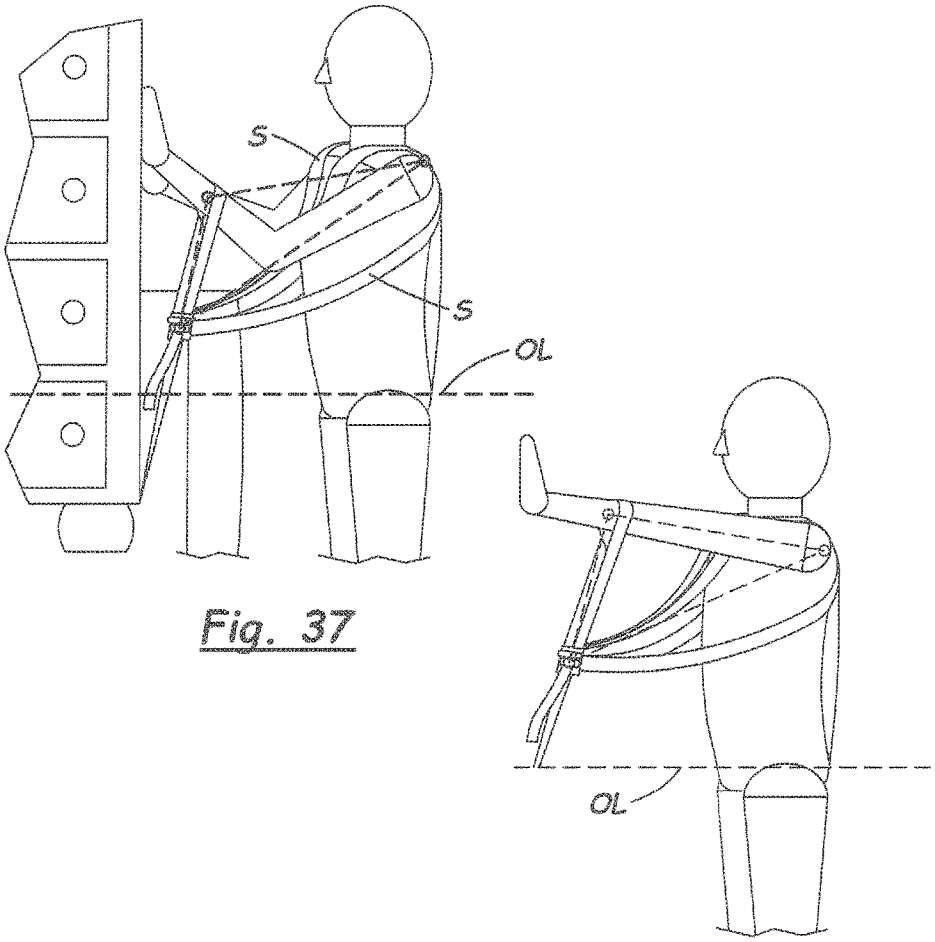
Fig. 37
Fig. 38
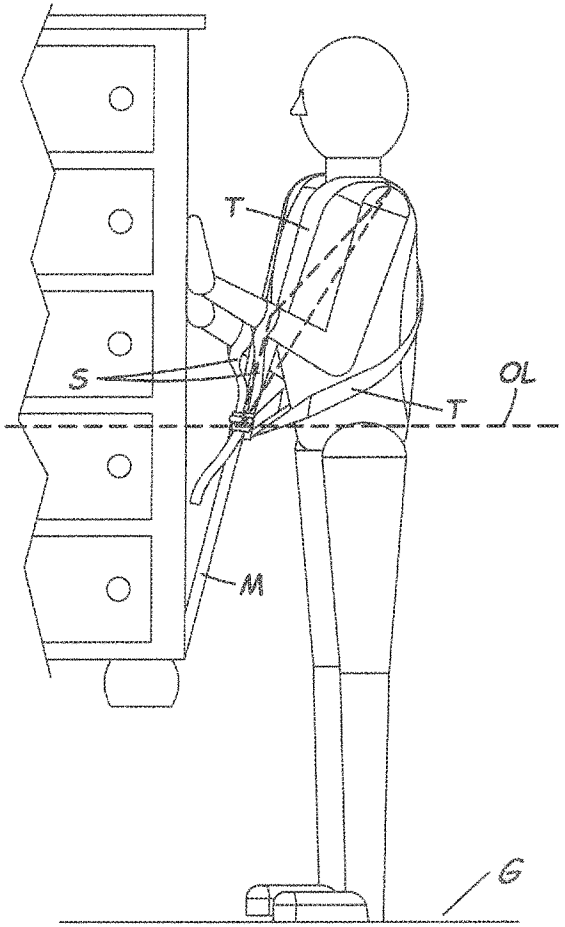
Fig. 36

STRAP LIFTER FOR USE BETWEEN TWO PERSONS WITH MULTIPLE LIFTING OPTIONS

BACKGROUND OF THE DISCLOSED TECHNOLOGY

Field of the Disclosed Technology

The disclosed technology relates generally to the delivery, moving, or relocation businesses. More specifically, the disclosed technology relates to a lifting system that helps people lift and maneuver heavy and/or bulky objects, for example, home appliances and furniture.

The lifting system may comprise a harness having a central buckle engaging a lifter strap, and right and left arm loops operatively connected to the central buckle and/or to the harness close to the central buckle. Typically, a set of two shoulder harnesses is provided to adjustably capture opposite ends of a single central lifter strap, so that two wearers may lift an object by applying force to the central lifter strap via the shoulder harnesses and/or the arm loops.

Related Art

U.S. Pat. No. 1,535,208 (Drennan) discloses a body lifter harness with a shoulder harness and a central buckle for securing the harness straps and supporting a central strap with a hook.

U.S. Pat. No. 2,431,780 (Theal) discloses a load carrying pair of straps connected by a central strap with a buckle, each load carrying strap being secured to a shoulder harness of a person.

U.S. Pat. No. 6,508,389 (Ripoyla et al.) discloses a harness for lifting. The harness having a bottom strap which is linked together with the bottom strap of another, identical harness at a cross-over point.

U.S. Pat. No. 6,641,008 (Falzone et al.) also discloses a shoulder strap harness lifter for two persons with a central strap being connected to each harness by the shoulder straps each being threaded through one of a series of openings in the central strap.

U.S. Pat. No. 6,729,511 (Dent '511) discloses a lifting harness for the shoulders of two persons with a wide, conventional central tension buckle and a web lift strap threaded through the buckle.

U.S. Pat. No. 7,331,493 (Dent '493) discloses a lifting harness similar to the one disclosed in Dent '511 above, except in Dent '493 the shoulder straps are threaded through holes in the central buckle, versus the shoulder straps having carabiners for supporting the central buckle in Dent '511. Dent '493, then, discloses a one-piece buckle that is loose on the webbed harness.

An embodiment similar to the disclosure of Dent '493 is marketed as the SHOULDER DOLLY® by Nielsen Products, LLC of Boulder, Colo., USA. (SHOULDER DOLLY® is a registered US trademark owned by TDT Moving Systems, Inc. of Colorado, USA.)

SUMMARY

The invention comprises a lifter system, and/or methods of using the lifter system, to help lift and maneuver heavy and/or bulky objects, such as home appliances and furniture, for example. The lifter system comprises a harness portion for encircling part of a user's body, a buckle portion, at least one arm loop for encircling at least one of the user's arms, and at least one lifter strap for supporting or otherwise engaging an object to be lifted. The lifter system may be worn and used with both, or with only one, of the harness portion and the at least one arm loop in operative position for lifting. Thus, in certain embodiments, both the harness and the at least one arm loop (preferably a right and a left arm loop) are worn on the user's shoulders/torso and arms, respectively, and used for lifting. In certain embodiments, the harness only is used for lifting, and the arm loop(s) are slack and/or off the arms and stowed, hanging, or detached from the system. In certain embodiments, only the arm loop(s) are used for lifting, with the harness slack, and/or off the shoulders/torso and stowed, hanging, or detached from the system. Further, when two people cooperate to use the lifter system to control at least one central lifter strap between them, each person may wear and/or use the harness and/or arm loop portions as they prefer for the particular lifting job, and each person may choose to wear and/or use different of said portion(s) than the other person. In other words, each person may choose to wear and/or lift with the harness only, the arm loops only, or both, typically independently from the choice of the other person.

The harness portion may comprise shoulder loops that may encircle at least a part of the wearer's shoulders and torso. The buckle portion comprises a front, central buckle that operatively connected to (attaches to or otherwise operatively engages) the harness portion, and that resides at or near the wearer's lower, central torso. The central buckle is preferably located at or near the vertical, front-to-rear mid-plane of the harness portion when it is worn, and, therefore, also typically at or near the vertical, front-to-rear mid-plane of the wearer's body. The at least one arm loop preferably comprises two arm loops, that is, a right arm loop and a left arm loop. The right and left arm loops preferably each comprise, at or near one end, a single opening for receiving the arm of the wearer, and, at or near the opposite end, a connection to the buckle portion or to the harness near the buckle. In certain embodiments, the arm loops may be detachable or stowable for applications wherein the user knows he/she will use the harness but not the arm loops for lifting. Preferably, the arm loops are adjustable, for example, the opening, length of the arm loops, and/or location of connection to the buckle portion or harness portion may be adjustable in size and/or location in certain embodiments.

Preferably, two harnesses and/or two sets of arm loops, worn by two persons standing face-to-face, are employed with one central lifter strap between the two buckles to place under and help lift and carry heavy and/or bulky objects. However, in certain embodiments, one person with the harness and/or arm loops can use the central lifter strap to secure large, ungainly loads that are still light enough to lift safely. Also, more than one lifter strap may be secured to one person when the system is fitted with several strap-engaging buckle or buckle portions, but said multiple buckles or buckle portions are preferably all centered or generally centered on the front of the harness and the wearer. Also, in certain embodiments, the buckle may be effectively provided by a harness with an integrated buckle, or a strap or hook system with an integrated buckle, that is secured to a fixed point, like on a post or wall, and a lifter strap threaded through the buckle and operated by one or more persons not connected to the harness to pull or lift an object on the lifter strap.

Therefore, in certain embodiments, the lifter system comprises a pair of shoulder harnesses, each with a central buckle and two arm loops, and a central lifter strap of nylon web, or other strong material. Said lifter strap extends between, and is adjustably engaged and captured by, the central buckles that are worn and controlled by two people, each person wearing and/or using any combination of the lifter system portions, that is, the harness, arm loops, or both. Preferred embodiments comprise only a single central lifter strap, centered underneath the object being lifted and/or directly underneath the center of gravity of the object being lifted. Because the preferred single, central lifter strap is captured and controlled by the central buckles that are centered on or near the wearer, the forces on the central lifter strap will originate and be centered at or near the centers of the two people applying the forces. This will provide controlled, balanced, and predictable forces that will tend to be safe and effective for carrying and moving the lifted object.

Forces applied to the central lifter strap by the wearer via the arm loop(s) may substitute for, or supplement, the forces applied to the central lifter strap via the wearer's torso and shoulders. This may be particularly important for situations wherein it is desired to raise the lifted object to a position or resting place that is higher than is possible with only torso- and shoulder-lifting. Said torso- and shoulder-lifting is limited to raising the lifted object to a maximum level defined by 1) the height/stature of the user, and 2) the dimensions of the shoulder harness and where the central buckle is connected to the shoulder harness, wherein these items 1 and 2 dictate how far above the floor/ground the central buckle(s) is/are located, and 3) how far the central lifter strap extends downward relative to the central buckle(s). In cases wherein only torso- and shoulder-lifting is possible, and wherein the wearers' hands are not used to further lift the object, the highest the bottom of the lifted object may be lifted is defined by the bottommost extremity of the central lifting strap, which will be, at the highest, at the level where the central lifting strap is captured by the buckle. However, with arm loops provided, the wearers may raise their arms to pull the arm loops up, which pulls up the central buckle(s), and the harness near the arm loops if the harness is being worn, and therefore, pulls up the central lifter strap further than if the arm loops are not used.

It is an object of many embodiments of the invention, therefore, to provide a lifter system wherein the only lifting strap, or alternatively all lifting straps, for extending under or attaching to an object to be lifted and carried, operatively connect(s) to the harness at a central front location, preferably via a central buckle, rather than at a right side or left side of the harness. It is also an object of many of the embodiments of such a lifter system, to provide arm loops that are also operatively connected to the harness at a central front location, preferably also via the central buckle, rather than at a right side or left side of the harness. This way, in the preferred embodiments, the lifting forces, for example all the lifting forces on a single central lifting strap, tend to be centered relative to the harness, relative to the body of the person, and relative to the center of gravity of the user. Additional objects and details of certain embodiments will be apparent from the following discussion.

BRIEF DESCRIPTION OF THE DRAWINGS

FIGS. 9-15 are front perspective views of embodiments of arm loops, wherein:

FIG. 9 shows an arm loop comprising an arm aperture for receiving a user's forearm, and an opposing buckle aperture for connecting to a central buckle, or to a harness near the central buckle.

FIG. 10 shows an arm loop that loops around a single interior space, wherein a portion of the interior space may be used as an arm aperture for receiving a user's forearm, and a portion of the interior space may be used as a buckle aperture for connecting to a central buckle, or to a harness near the central buckle.

FIG. 11 shows an arm loop having an arm aperture for receiving a user's forearm, and connection end for sewing to a central buckle or a harness near the central buckle.

FIG. 12 shows an arm loop having an arm aperture for receiving a user's forearm, and an opposing connection end buckle for detachable connection to a central buckle or a harness near the central buckle.

FIG. 13 shows an arm loop having an arm aperture for receiving a user's forearm, and series of connection end apertures for detachable connection to a central buckle or a harness near the central buckle.

FIG. 14 shows an arm loop having an arm aperture for receiving a user's forearm, and connection end hook for detachable connection to a central buckle or a harness near the central buckle.

FIG. 15 shows an arm loop having an arm aperture for receiving a user's forearm, and connection end rivets, grommets, or other fasteners for connection to a central buckle or a harness near the central buckle.

FIG. 36 is a side, detail view of one user and the lifter system of FIGS. 32-35, wherein a dashed-line shoulder-buckle-forearm triangle illustrates the relationships and positions resulting in harness-only lifting even though the arm loops are on the user's forearms.

FIG. 37 is a side, detail view of one user and the lifter system of FIGS. 32-36, wherein the shoulder-buckle-forearm triangle illustrates the relationships and positions resulting in arm loop lifting, rather than harness lifting, by raising of the arms so that the buckle is raised above the buckle level in FIG. 36.

FIG. 38 is a side, detail view of one user and the lifter system of FIGS. 32-37, wherein the shoulder-buckle-forearm triangle illustrates the relationships and positions resulting in continued arm loop lifting, by further raising of the arms so that the buckle is raised above its level in FIG. 37.

DETAILED DESCRIPTION

Referring to the Figures, there are shown several, but not all, embodiments of the invented lifter system. In the Summary of the Invention above, and in this Detailed Description, and in the accompanying drawings, reference is made to particular features, including method steps, of embodiments of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

Figure 1:
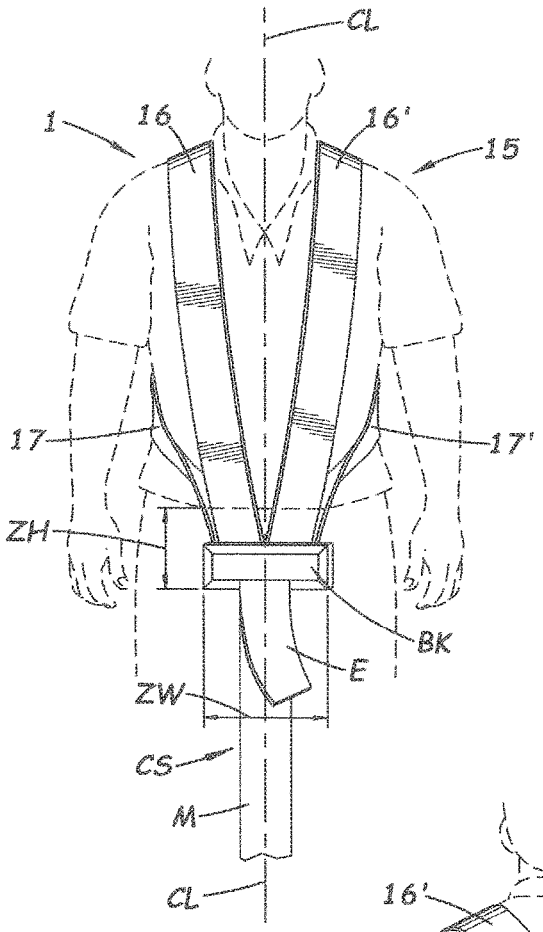
FIG. 1 is front view of one embodiment, of a shoulder harness with central buckle capturing a single central lifter strap and being worn by a user, which may be adapted with arm loops to substitute for, or supplement, lifting by the torso/shoulders.
Figure 1A:
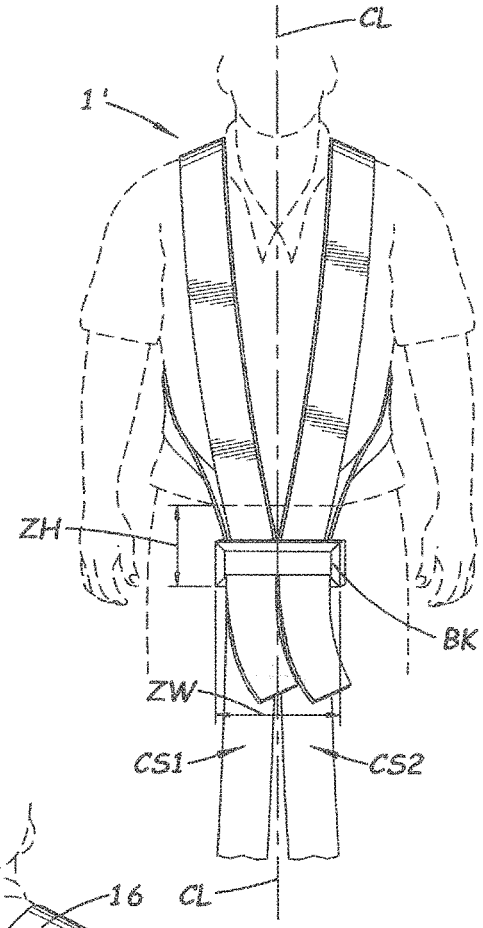
FIG. 1A is a front view of the embodiment of FIG. 1, with the central buckle capturing two central lifter straps.
Figure 2:
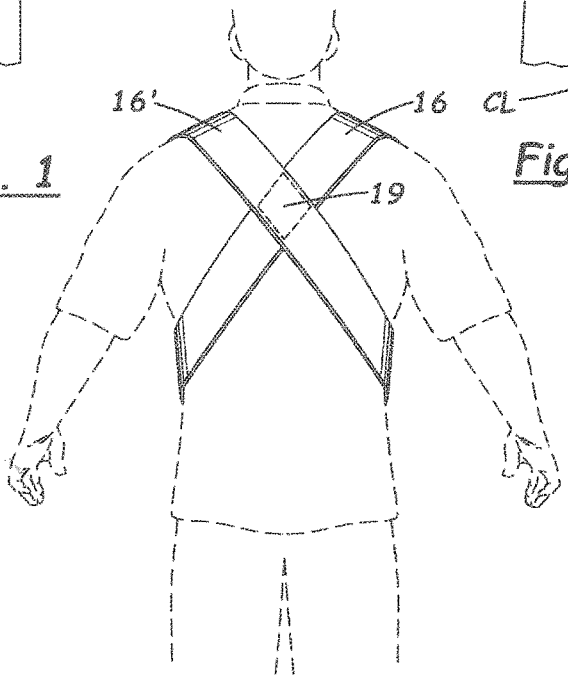
FIG. 2 is a rear view of the shoulder harness of FIGS. 1 and 1A.

The front views of FIGS. 1 and 1A, and the back view of FIG. 2, illustrate a lifter system 1, 1' with an embodiment of a shoulder harness 15 with a central buckle BK, wherein the system 1, 1' may be adapted by addition of arm loops for improved lifting and maneuvering of a lifted object. The central buckle BK is drawn to be somewhat generic, as many different styles of central buckles may be provided in certain embodiments of the invention. For example, the buckle may be a sliding-bar-buckle with a sliding bar that captures the central lifter strap against another portion of the sliding-bar-buckle, a flexible-loop-buckle with a loop that flexes to capture the central lifter strap against another portion of the flexible-loop-buckle, a cam, snap, latch, lock, hook, pin, peg, clamp, clip, clasp, compression, friction, grip, and/or other engagement mechanism that is capable of capturing the lifting strap for the purpose of carrying a load.

FIG. 1 shows a single central lifter strap CS, and FIG. 1A shows two central lifter straps CS1, CS2, entering and exiting the buckle BK housing/casing. It should be understood that gripping or other strap-retainer mechanism internals (not shown) are provided inside the buckle housing/casing to capture the lifter strap(s) CS, CS1, CS2, and retain the strap(s) in the desired position/length relative to the buckle and hence relative to the harness 15. From the description below and the drawings as a whole, it will be understood that many different buckle components and strap-retainer mechanisms may be used in certain embodiments of the invention.

Figure 3:
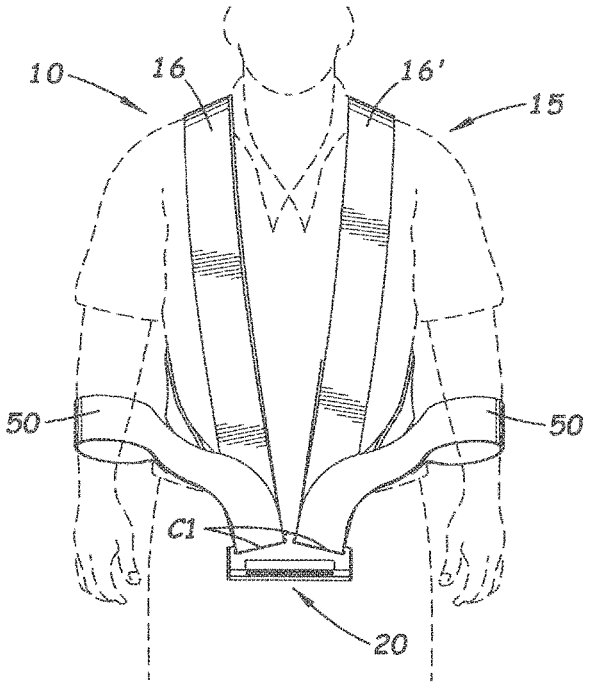
FIG. 3 is a front view of an embodiment of a shoulder harness with central buckle and two arm loops, the embodiment being worn by a user whose arms are lowered so that the arm loops are slack.

The shoulder harness 15 of FIGS. 1-3 comprises a right shoulder loop 16 and a left shoulder loop 16', which may be described as extending at least part way around their respective shoulders and the torso. The loops 16, 16' extend up from the central buckle BK, over their respective shoulders, cross and connect at connection 19 on the user's back between the shoulder blades (see FIG. 2), and extend along respective sides of the torso (side-strap-portions 17', 17), to again connect to each other (directly or indirectly) at or near the central buckle BK. This way, the front-most and lowermost portions of the shoulder loops 16, 16' are connected by or at the central buckle BK. As weight is placed on the central buckle BK, as described later in this document, by the single central lifter strap CS of FIG. 1, or the two central lifter straps CS1, CS2 of FIG. 1A, the central buckle will tend to be pulled down to be the lowermost portion of the entire shoulder harness 15.

Preferably, as illustrated by FIGS. 1 and 1A, at least one central lifter strap CS, CS1, CS2 is threaded through a gripping mechanism or other strap-retaining mechanism of the buckle in such a way that the end E and the main portion M both extend away from the buckle BK, but the main portion M extends to pass under or to otherwise engage an object to be lifted. Preferably, the buckle BK is designed so that the user can adjust the strap CS, CS1, CS2 in the buckle to shorten and lengthen the main portion (thus, lengthening or shortening the end E, respectively) to adjust the length of the main portion that extends from the buckle BK typically to the buckle of another harness worn by a second user. Shortening the main portion M is typically necessary so that the strap CS, CS1, CS2 will extend under the object to be lifted (often with the users bending or crouching down) but will be short enough to lift the object when the users stand up straight.

Engagement of the strap CS, CS1, CS2 by the buckle may be by various capturing and retaining mechanisms. For example, capturing and retaining mechanisms may comprise, consist essentially of, or consist of, the strap being pinned, hooked, pegged, or otherwise fastened by placing one or more fasteners through the strap body. Alternatively, and more preferably in order to make length-adjustment easier, capturing and retaining mechanisms strap may comprise, consist essentially of, or consist of, mechanisms for gripping, pinching, or otherwise frictionally holding, the strap outer surface(s). For example, a gripping system may be provided wherein a bar or other member slides against another member to capture the strap CS, CS1, CS2 inbetween. Or, a gripping mechanism may be provided wherein a flexible member or a flexible portion of a member flexes to allow the member to move against another member to capture the strap CS, CS1, CS2 inbetween. Or, the gripping mechanism could be a latch member that swings over the strap to push it against another member.

FIGS. 1 and 1A illustrates the boundaries of the preferred location of connection of arm loops to the shoulder harness 15. The arm loops may be attached to a portion of the buckle BK, or may be attached to the shoulder harness preferably very close to the central buckle. In the latter option, the arm loops are preferably attached to the shoulder loops or a connector between the shoulder loops above the central buckle (rather than beside or below) and within a few inches above the topmost edge/surface of the central buckle. For example, it is preferred that the arm loops are attached or connected to the harness 15 shoulder loops 16, 16' or to the buckle BK, in the zone shown in FIGS. 1 and 1A that is bounded by zone width ZW and the zone height ZH. The preferred zone width is the maximum width of the central buckle BK, thus, extending from the farthest-right extremity of the buckle BK to the farther-left extremity of the buckle BK. The preferred zone height extends from the bottom-most extremity of the buckle BK to a location on the harness several inches above the buckle, for example, up to 5 inches above, up to 4 inches above, up to 3 inches above, or up to 2 inches above, the top-most extremity of the buckle. For many embodiments, the highest location of attachment of the arm loops is 3 inches above said top-most extremity of the buckle, as that will equate to being at or below the waist line of most users. It will be understood that the zone has a depth corresponding to the depths of the buckle BK and the harness 15 within said zone.

As may be understood by the arm loop connection zone in FIGS. 1 and 1A as shown by zone width ZW and zone height ZH, the arm loops are preferably installed in a front, central location of the harness. Most preferably, the arm loops are installed on, or close to, a central buckle of the harness that connects the front portion of the right and left shoulder loops of the harness. This way, the central buckle and the proximal ends of the arm loops are positioned against, or directly in front of, a lower, central portion of the user's "belly" or torso, centered between the right and left sides of the user. This keeps the weight of the lifted object centered at the front-to-rear centerline/centerplane CL in FIGS. 1 and 1A (the plane extending into the page) of the harness, and against/near the centerline-centerplane CL of the user's torso, rather than distanced to the right or left of the harness and/or the right or left of the user. Thus, weight on the preferred single central lifter strap is supported by the preferred single, front, central buckle, and that weight is distributed, in many embodiments and/or in many uses, equally to both shoulders, to center of the user's back, and, hence, to the user's torso, hips, and/or legs. However, even in the case of the multiple central lifter straps, all central lifter straps are preferably captured so that their captured ends are very close together, preferably, symmetrically on right and left sides of, but within 6 inches or less of, the centerline/centerplane CL of the buckle(s) or other capturing hardware. For example, one may see in FIG. 1A that the two straps CS1, CS2 are supported by the preferred single, front, central buckle, and the weight of the lifted load may be distributed, in certain embodiments and/or in certain uses, equally to both shoulders, to center of the user's back, and, hence, to the user's torso, hips, and/or legs.

FIGS. 3-6 illustrate an alternative embodiment of lifter system 10, having an embodiment of a central buckle 20 that is drawn with more specificity than in FIG. 1 and that comprises a sliding gripping mechanism, and right and left arm loops 50 connected to the central buckle 20 at connection C1. The shoulder harness 15 and its buckle 20 may be made generally according to the teachings of Dent, III in U.S. Pat. No. 7,331,493, issued Feb. 19, 2008 and incorporated herein by reference, and/or according to the shoulder harness and central buckle embodiment(s) marketed as the SHOULDER DOLLY® by Nielsen Products, LLC of Boulder, Colo. (SHOULDER DOLLY® is a registered US trademark owned by TDT Moving Systems, Inc. of Colorado, USA.)

Buckle 20 comprises a rigid back-plate with a back-plate opening 23 and right and left harness apertures 24, 24', right endplate 26 and left endplate 26', and sliding gripping bar 30 having right and left bracket ends 34, 34' that engage endplates 26, 26', respectively, and slide up and down in the respective apertures 28, 28' in said endplates 26, 26'. A user may manually slide the gripping bar 30 upward to about the center of the back-plate opening 23 (as measured from the top to the bottom of the back-plate opening 23), and then "thread" the central lifter strap from the rear of the buckle 20, through the opening 23, around the bar 30, and back out through the opening 23 toward the rear of the buckle 20. This way, the strap extends around the bar 30 and twice through the opening 23, so that the strap extends downward along the back surface of the back-plate to extend away from the buckle 20. When the buckle 20 is held vertically (with back-plate 22 vertical), the "bar-encircling portion" of the strap may be described as extending forward through the opening 23, around the bar 30, and back, rearward through the opening, all above the lower, solid and rigid portion 29 of the back-plate. The encircling portion therefore "encircles" about ½-⅔ of the circumference of the bar 30, and once in this position and adjusted to provide the desired main portion length, the user slides the bar 30 and the encircling strap portion (for example, by pulling downward on the lifter strap portions), toward portion 29 of the back-plate 22. This way, said encircling portion is gripped around about ½-⅔ of its circumference by the preferably-textured or knurled bar, and captured between the bar 20 and the back-plate portion 29 upper edge.

As shown by FIG. 3, each of right and left arm loops 50 has an outer/distal end having a single loop (or, a single "aperture"), through which the user extends his/her right and left forearms. The arms loops are preferably non-elastic and non-stretchable, and the single loop is preferably flat enough, or has padding or reinforcement and cushioning, to not bite into arm skin.

In the system 10 of FIG. 3, the inner/proximal ends of the preferably non-elastic and non-stretchable arm loops 50 extend to or through the same apertures as the right and left shoulder loops, for example, right and left harness apertures 24, 24', to form connection C1. This connection may be generally or entirely outside the shoulder loops, for example, with the arm loop inner/proximal ends looping through the apertures outside of the shoulder loops, or with the inner/proximal ends attached to the shoulder loop material at or near the apertures 24, 24'. This way, the arm loops extend, from a connection that is generally or entirely outside the shoulder loops, out and away from the shoulder loops, to place the distal ends of the arm loops at the desired distance from the shoulder loops and buckle. Examples of some, but not all, arm loop connections that are "generally or entirely outside" the shoulder loops are schematically illustrated in FIGS. 41A-F.

Figure 3A:
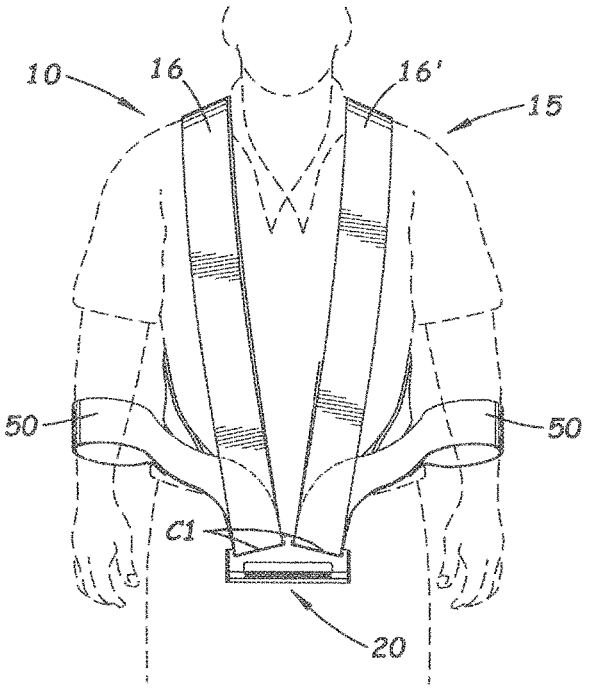
FIG. 3A is a front view of an embodiment the same as that in FIG. 3, except wherein the two arm loops are connected to the buckle and/or harness so that they extend out from inside the harness shoulder loops.
Figure 5:
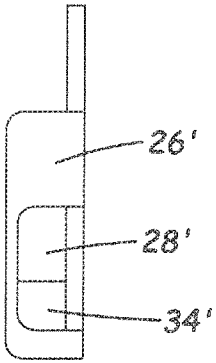
FIG. 5 is an end view of the buckle of FIGS. 3 and 4.
Figure 4:
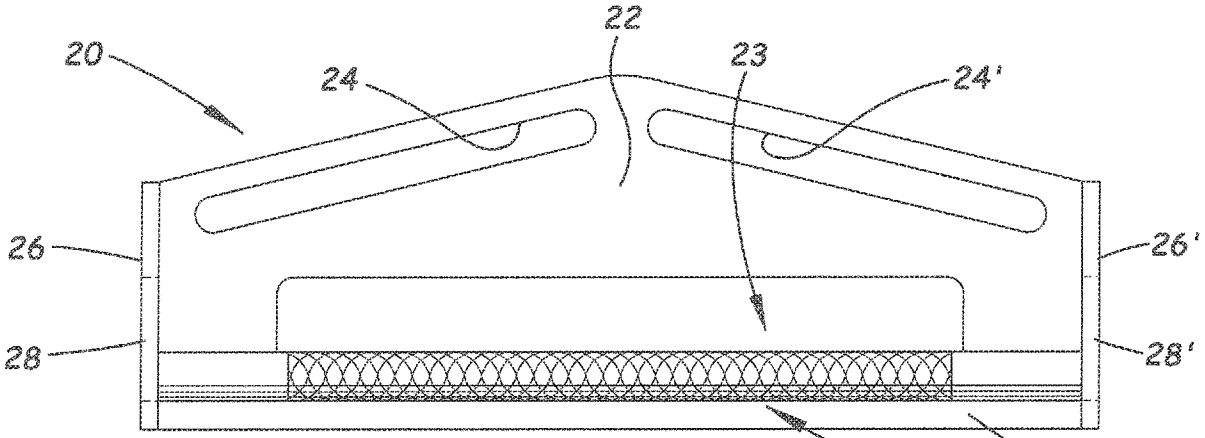
FIG. 4 is a front, enlarged view of the buckle of FIG. 3.
Figure 6:
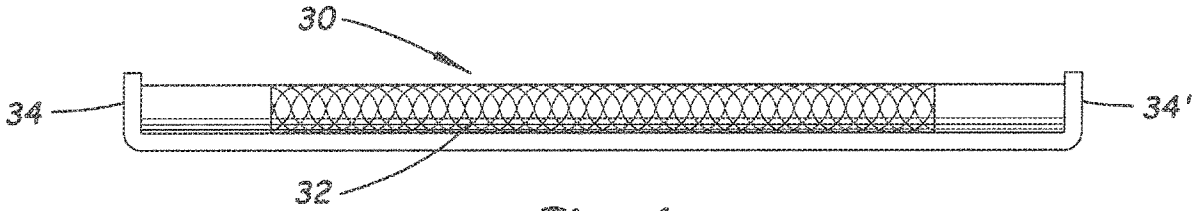
FIG. 6 is a bottom view of the buckle of FIGS. 3-5.

Alternatively, as shown in the system 10' of FIG. 3A, the inner/proximal ends of arm loops 50' may be connected to the buckle 20 and/or shoulder loops 16, 16' inside the shoulder loops 16, 16'. This way, the arm loops extend, from a connection that is generally or entirely inside the shoulder loops, out and away from the shoulder loops, to place the distal ends of the arm loops at the desired distance from the shoulder loops and buckle. Examples of some, but not all, arm loop connections that are "generally or entirely inside" the shoulder loops are schematically illustrated in FIGS. 42A-E.

Figure 7:
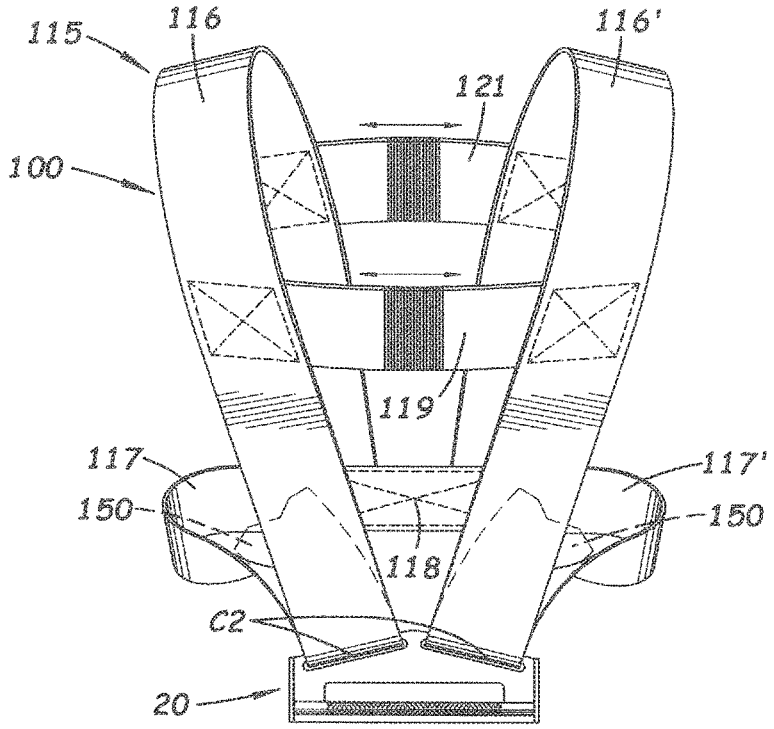
FIG. 7 is a front view of an alternative shoulder harness with a central buckle as in FIGS. 3-6, wherein arm loops (partially shown in dashed lines) may be added to this embodiment in a manner similar to that shown in FIG. 3.
Figure 8:
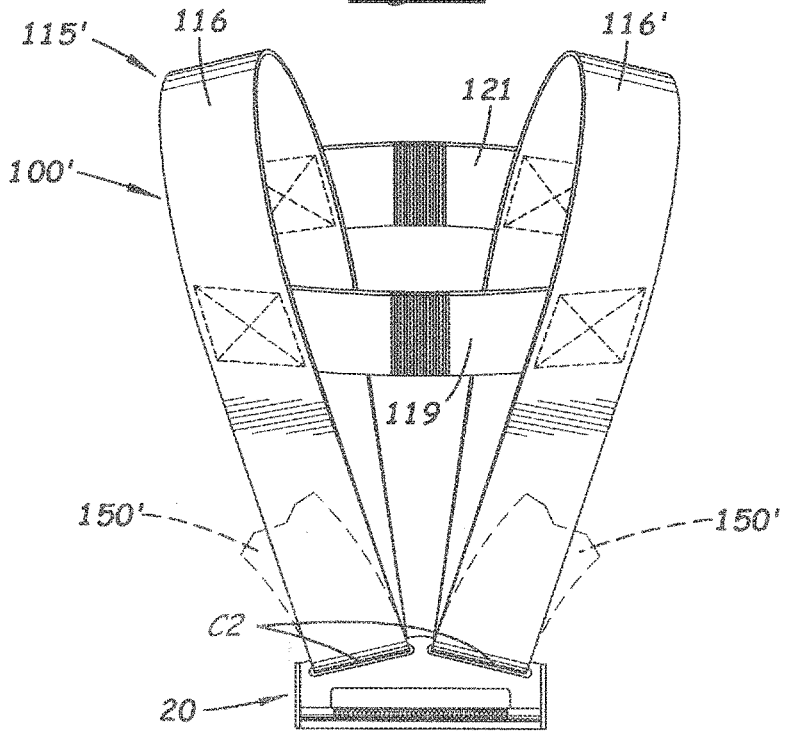
FIG. 8 is a front view of an alternative shoulder harness with a central buckle as in FIGS. 3-6, wherein arm loops (partially shown in dashed lines) may be added to this embodiment in a manner similar to that shown in FIG. 3.
Figure 9:
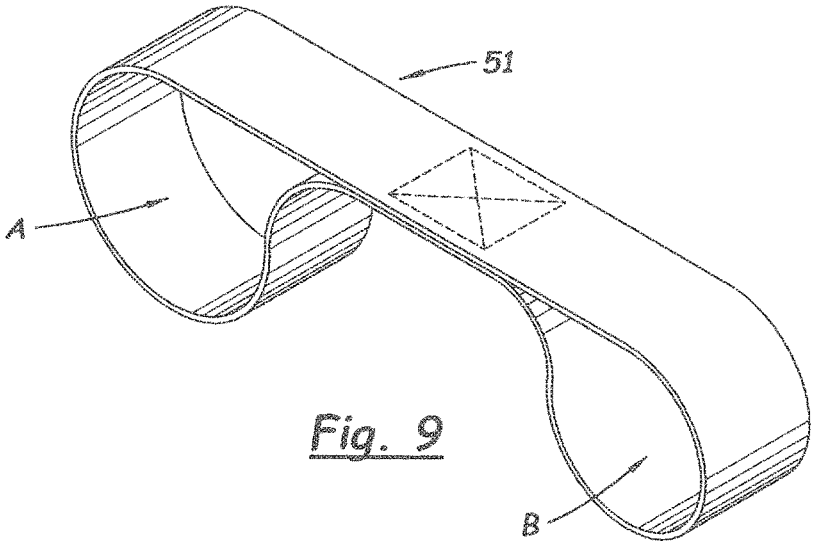
Figure 10:
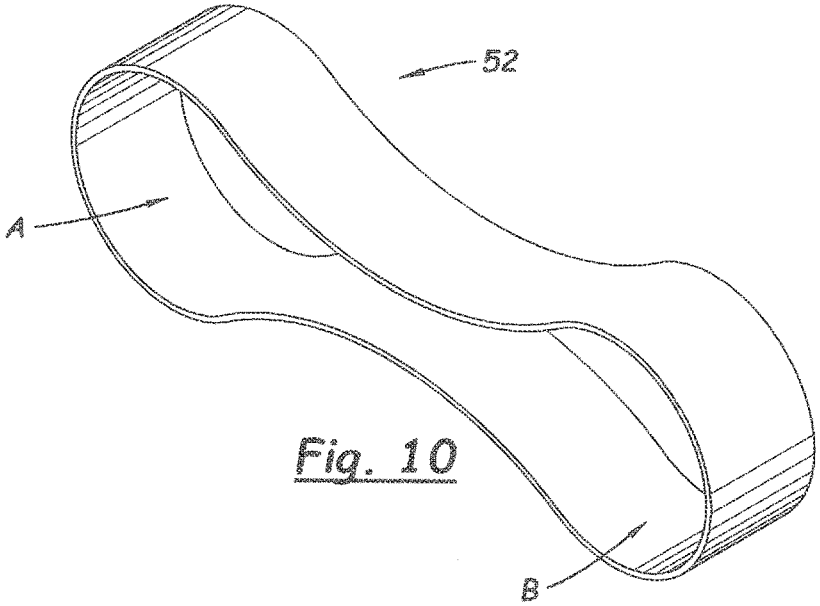
Figure 11:
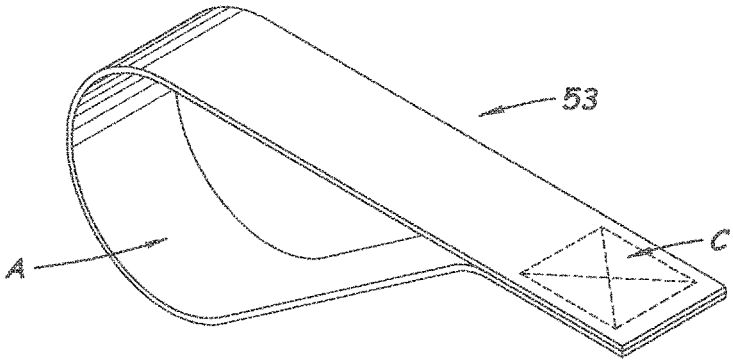
Figure 12:
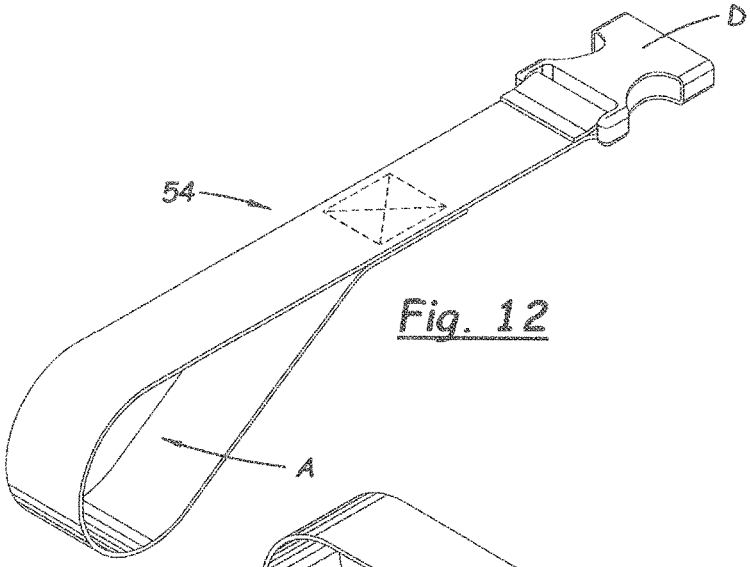
Figure 13:
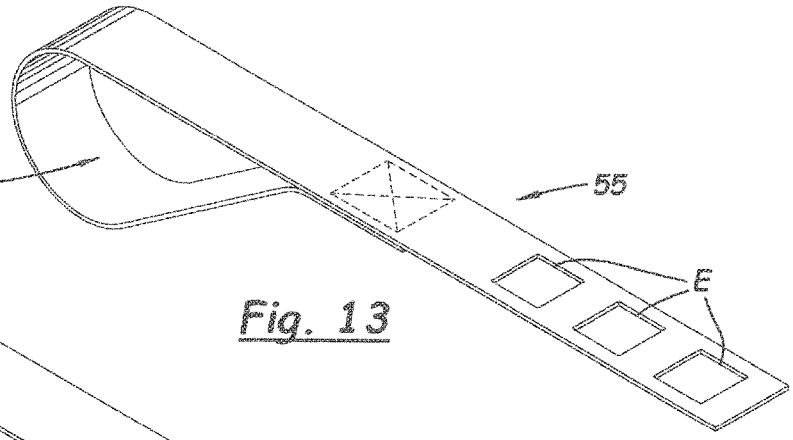
Figure 14:
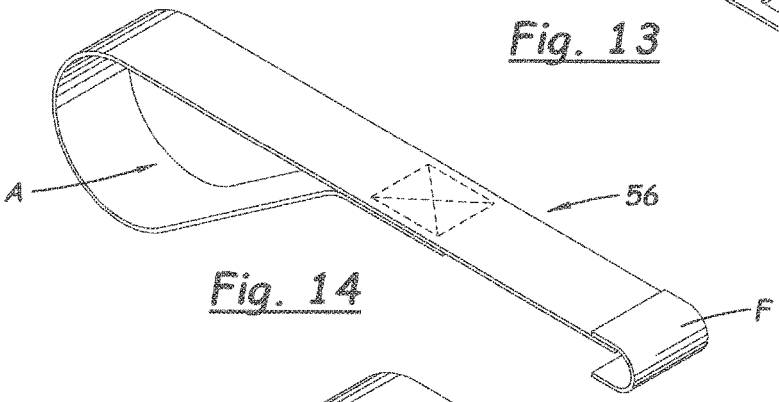

FIGS. 7 and 8 show alternative embodiments 100, 100' that feature harnesses 115, 115' that are some, but not the only, embodiments that may be used with the buckle 20 of FIGS. 3-6. Further, these harnesses 115, 115' may be adapted to include arm loops 150, 150' (partially shown, in dashed lines) by connection at connections C2, C3, or, alternatively, at any location of "operative connection", which may be on the buckle 20, or on the harness strap(s) at or near the buckle 20 (for example, on the harness strap(s) 0-5 inches, 0-3 inches, or 0-2 inches, above the top end of the buckle). Harnesses 115, 115' have right and left shoulder loops 116, 116', and also have front and rear horizontal cross-straps 119, 121, sewn to the shoulder loops 116, 116' that may be elastic or expandable as suggested by the associated horizontal arrows. Embodiment 100 further comprises a waist belt that has right and left waist belt portions 117, 117' that connect, and extend from, rear portions of the shoulder loops at connection/reinforcement 118, to extend around the sides of the user and connect to the buckle 20.

Many alternative harnesses may be used with arm loops and at least one lifter strap, in certain embodiments of the invention. For example, within the definition of "harness" in certain embodiments, may be devices comprising, consisting essentially of, or consisting of, shoulder loops/straps; connections between shoulder loops/straps at the front and/or back of the device; waist belt(s); sheet material and panel(s) instead of or in addition to loops/straps; garments such as a vest, a jacket, an apron; and/or other devices worn by a user on the user's upper body or torso, and comprising a buckle for at least one lifting strap. The preferred harness is designed and/or sized to allow substantial upward mobility of the buckle and the central lifter strap when arm loops pull on the buckle and/or the harness near the buckle. Therefore, while the harness may comprise, consist essentially of, or consist of, a waist belt that extends around the user's waist (see waist belt portion 117, 117' in FIG. 7), said waist belt should not be tight around the user's waist during use. Therefore, in certain embodiments, the load on at least one lifting strap may be carried by the harness and transferred, at least in part or at least at some times during the lift, to the wearer's shoulders/torso, and, hence, to their back, hips, and legs, but said harness is loose enough near the waist and lower torso to allow the buckle and also the lower front portions of the harness, to be lifted upwards by the arm loops when supplemental force from the arms is desired. Preferably, the harness is loose and non-restraining enough near the waist and lower torso that the buckle may be lifted up, from its resting position wherein no force is applied by the arm loops, at least 6 inches, at least 12 inches, or more preferably 12-24 inches.

Many alternative buckles may be used with the harnesses having arm loops, in certain embodiments of the invention. For example, within the definition of "buckle" in certain embodiments, may be devices that connect to at least one lifting strap by means of a sliding-bar-buckle with a sliding bar that captures the central lifter strap against another portion of the sliding-bar-buckle, a flexible-loop-buckle with a loop that flexes to capture the central lifter strap against another portion of the flexible-loop-buckle, a cam, snap, latch, lock, hook, pin, peg, clamp, clip, clasp, compression, friction, grip, and/or other engagement mechanism that is capable of capturing the lifting strap for the purpose of carrying a load.

Many alternative central lifter straps may be used in the apparatus and methods described herein. The central lifter straps portrayed in the figures are flat and continuous fabric or other flexible material, but each strap in certain embodiments may be other materials and shapes, such as woven, braided, coiled, sewn, extruded, molded, layered, or an otherwise fabricated elongated member, wherein each strap is preferably substantially continuous, but optionally may have apertures, holes, links, or other discontinuities.

Figure 15:
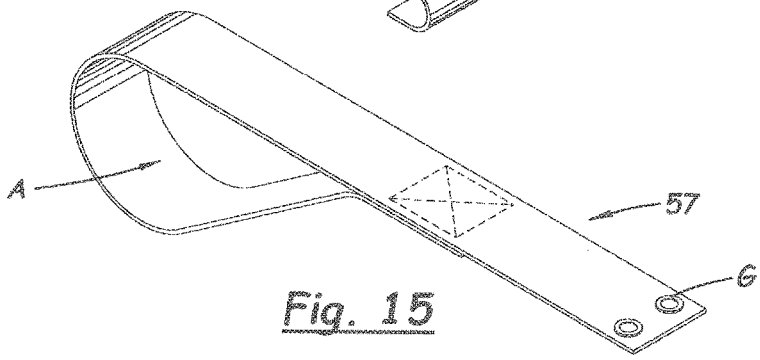

Many alternative arm loops may be used with harnesses having a central buckle. Various styles of arm aperture, and various styles of connections of the arm loops to the buckle and/or harness, may be used to provide multiple lifting options, that is, lifting of the central lifter strap via the arm loops as well as via the shoulder and torso regions of the harness. For example, FIGS. 9-15 illustrate some, but not the only, possible arm loops 51, 52, 53, 54, 55, 56, and 57. Each arm loop 51-57 comprises a single aperture A (FIGS. 9, 11, 12, 13, 14, and 15) or a single aperture portion A (FIG. 10) for receiving the user's arm, typically the forearm. An opposing aperture B (FIG. 9) or opposing aperture portion B (FIG. 10) may be provided at an opposite end of the arm loop for looping through or otherwise receiving a portion of the buckle (BK, 20) or a portion of the harness to connect the arm loop to the lifting system at or closely-above the buckle. Alternatively, fasteners or other connections may be provided at said opposite end from the arm aperture. For example, such fasteners/other-connection may comprise one or more of: a sewn/stitched connection C (FIG. 11), a snap-together or other detachable connection D (FIG. 12), apertures E (FIG. 13) for hooking over/on various hooks or protrusions on the buckle or harness, a rigid hook F (FIG. 14) for hooking onto/through a cooperating structure, and permanent or optionally disconnectable fasteners such as rivets or grommets G (FIG. 15).

Figure 16:
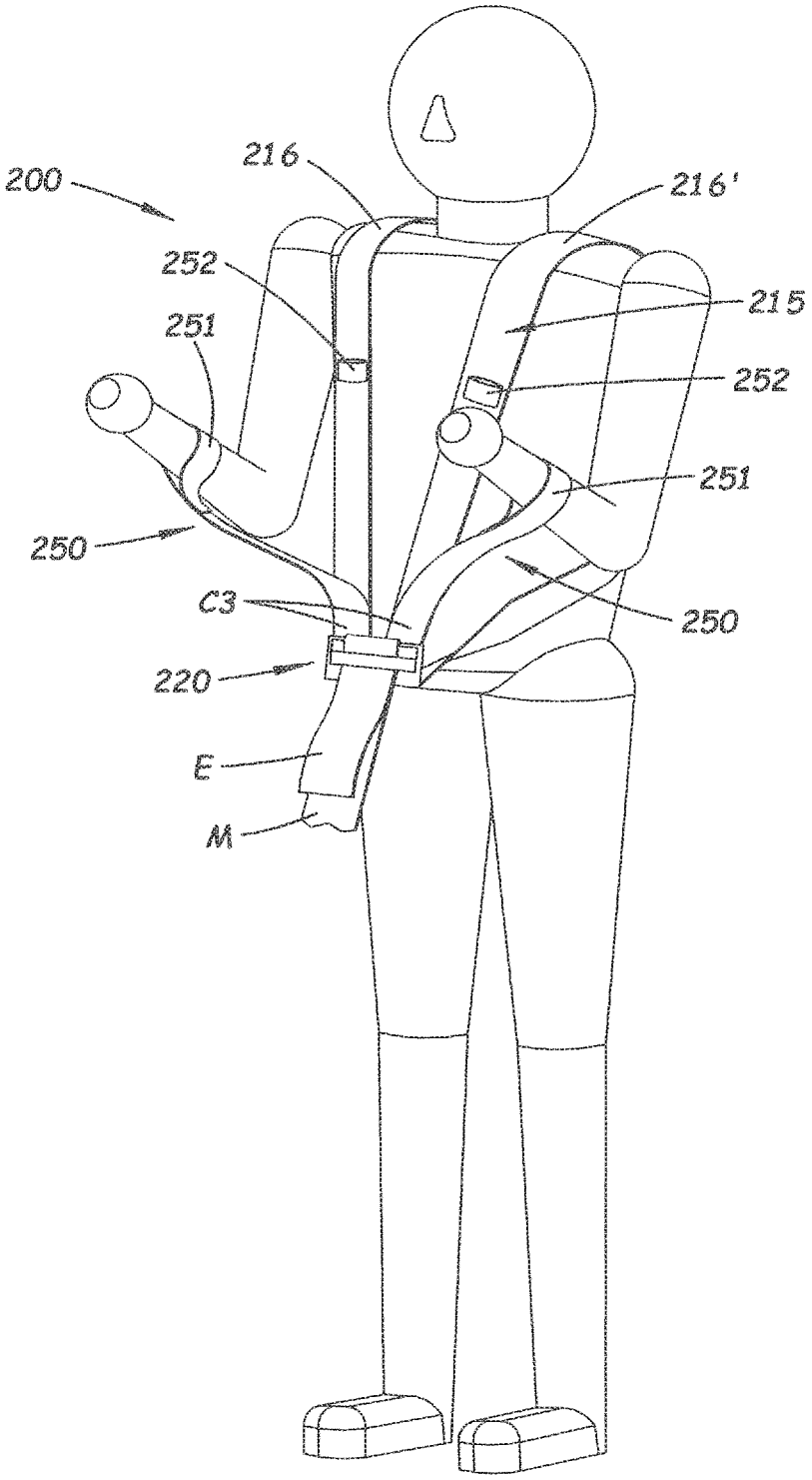
FIG. 16 is a front perspective view of a user wearing an alternative embodiment of a lifter system, wherein two arm loops are connected to the top end of an alternative embodiment of central buckle.

FIG. 16 illustrates an alternative embodiment of a lifter system 200, which incorporates a shoulder harness and central buckle made generally according to the teachings of the Nielsen U.S. Pat. No. 8,807,403 issued Aug. 19, 2014, and Nielsen U.S. Pat. No. 9,101,202 issued Aug. 11, 2015, which are both incorporated herein by reference, and/or according to the shoulder harness and central buckle embodiment(s) marketed as the READY LIFTER® by Nielsen Products, LLC of Boulder, Colo. (READY LIFTER® is a registered US trademark owned by DEN, INC. of Colorado, USA.). The lifter system 200 comprises harness 215, buckle 220, arm loops 250, and a lifter strap partially shown and called-out as end E and main strap portion M. One will understand, from the previous discussion in this document, that shoulder loops 216, 216' extend at least part way around the shoulders and torso of the wearer, to connect to the central buckle 220 at a centered, front location of the harness 215 and the wearer. Arm loops 250 each have a distal end 251 that loops/circles or otherwise forms a single, sole arm aperture. Each arm loop 250 also has an opposite, proximal end that connects to the buckle, or the harness at or very near the buckle, at connections C3. It will be understood that connection C3, as drawn in FIG. 16, may be a connection to an upper region of the buckle, and/or to the harness within about 1 inch above the buckle by stitching (not shown) or other permanent connection.

Figure 17:
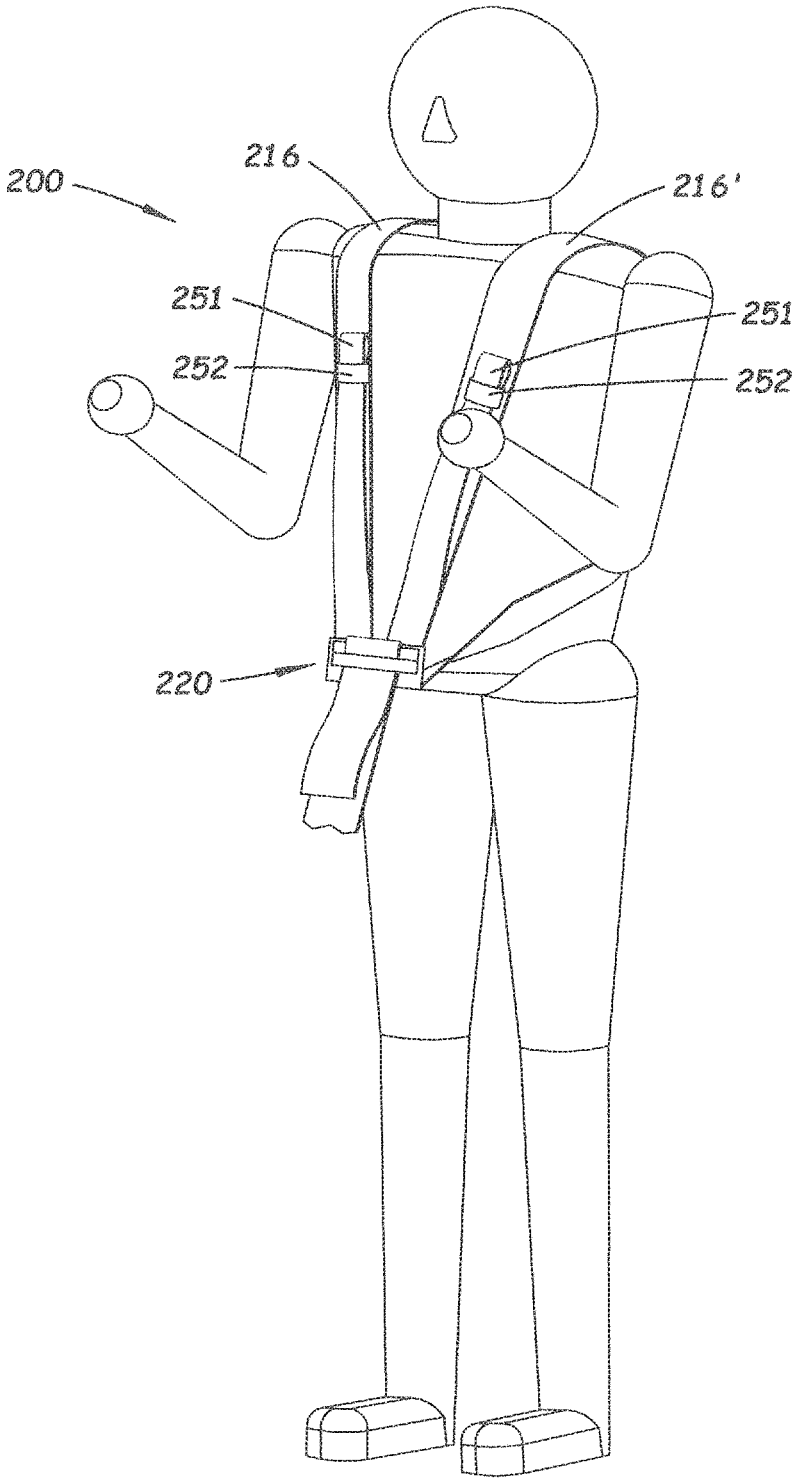
FIG. 17 is a front perspective view of a user wearing the embodiment of FIG. 16, wherein the arm loops are not in use and are stowed in a storage position.

Lifter system 200 also comprises means to stow/store the arm loops out of the way when not in use. In FIGS. 16 and 17, the means are small stow-loops 252 into which the distal ends of the arm loops are inserted. This way, as shown in FIG. 17, when not needed or wanted, the arm loops 250 are stowed so that each arm loop stays close to, and/or parallel to, its respective shoulder loop 216, 216' at or on the front of the user's chest. This way, when the arm loops 250 are not placed on the user's arms, they will not dangle or flop to be in the user's way. Alternative means for stowing/storing the arm loops may be ties, straps, hooks, or other fasteners that hold the arm loops, or folded arm loops, close to other portions of the lifter system 200 to prevent dangling or flopping.

Figure 18:
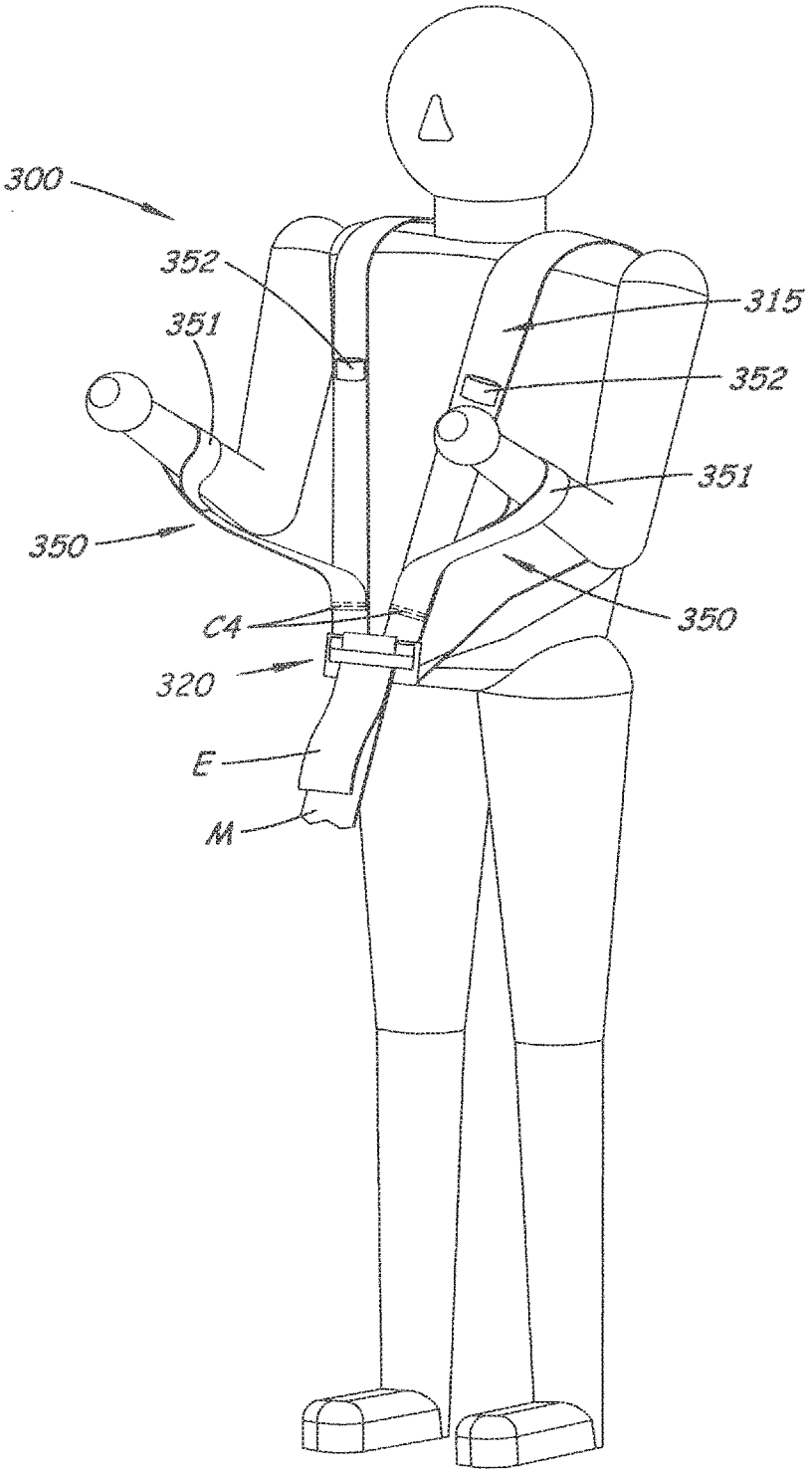
FIG. 18 is a front perspective view of a user wearing an alternative embodiment of a lifter system, wherein two arm loops are connected to the shoulder harness a short distance above the central buckle.

FIG. 18 illustrates an alternative embodiment of a lifter system 300, comprising harness 315, buckle 320, arm loops 350, lifter strap E and M, and stow-loops 352. Harness 315 is the same or similar to the harness in FIGS. 16 and 17, but the arm loops 350 are connected differently in this embodiment. Arm loops 350 each have a distal end 351 that loops/circles or otherwise forms a single, sole arm aperture, but the opposite, proximal end of each arm loop 350 connects to the harness above but very near the buckle at connections C4. Connections C4 are shown as sewing/stitches of the right and left arm loop proximal ends to right and left front portions of the shoulder loops, respectively, within 2-3 inches of the top edge of the buckle 320. In certain embodiments, other permanent or detachable connection may be used for connections C4 instead of sewing.

Figure 18A:
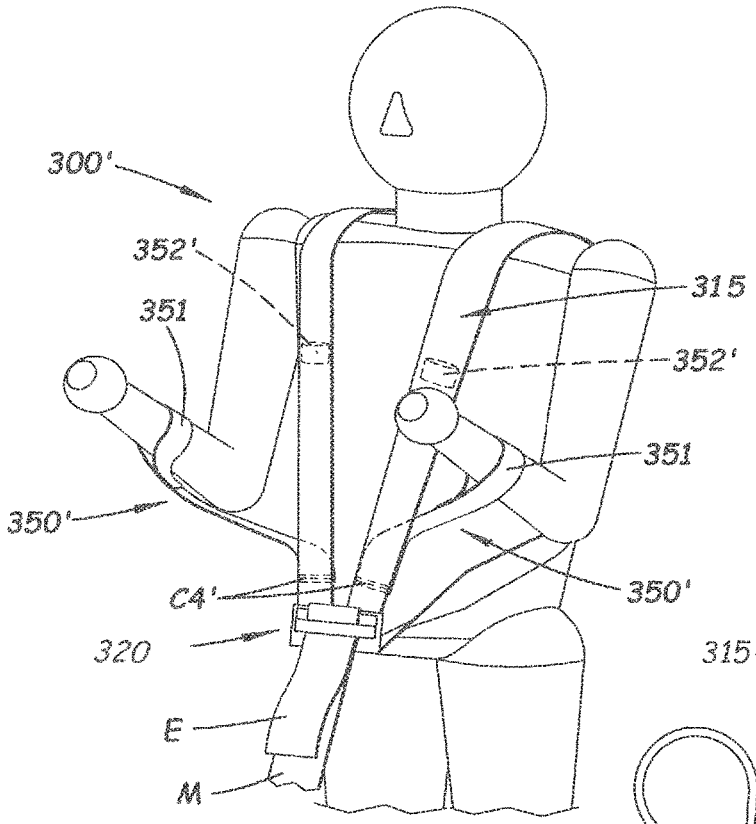
FIG. 18A is a front perspective view of a lifter system embodiment the same as that in FIG. 18, except that the arm loops and the stow loops are connected to the rear surface of the harness shoulder loops, and the arm loops extend out from inside the shoulder loops.
Figure 18B:
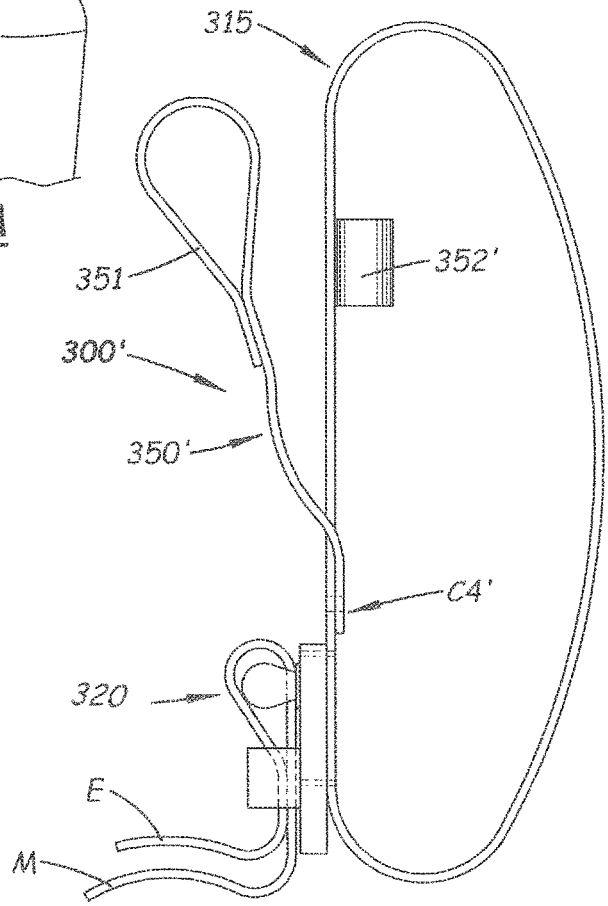
FIG. 18B is a schematic side view of the embodiment of FIG. 18A, removed from the user.

FIG. 18A and schematic FIG. 18B illustrate an alternative lifter system 300', wherein the arm loops 350' and stow-loops 352' are attached to the harness 315 inside the shoulder loops. Each arm loop 350' connects to the harness 315 above but very near the buckle at connections C4', by means of sewing/stitches of the right and left arm loop proximal ends to the inside surfaces of the right and left front portions of the shoulder loops, respectively, within 2-3 inches of the top edge of the buckle 320. In certain embodiments, other permanent or detachable connection may be used for connections C4' instead of sewing.

Figure 19:
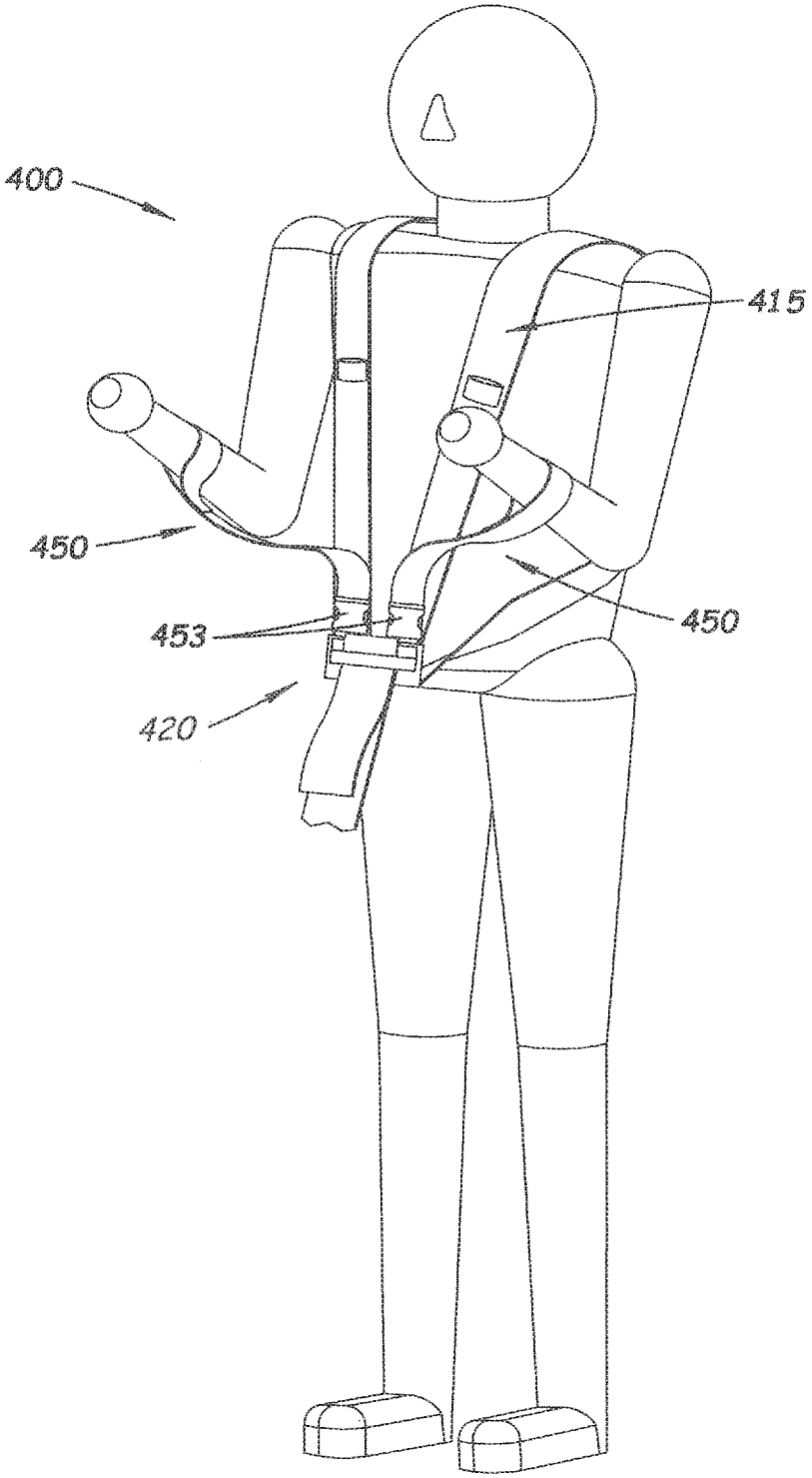
FIG. 19 is a front perspective view of a user wearing an alternative embodiment of a lifter system, wherein two arm loops are detachable connected to the central buckle or to shoulder harness very close to the central buckle.

As illustrated by the lifter system 400 in FIG. 19, the arm loops 450 may be detachable for cases wherein the user does not foresee the need for the arm loops 450. The arm loops 450 may be detached, from the buckle 420 or the harness 415, for example, by snap-disconnectors 453, or other snap or clip fasteners provided preferably at or near the lower end of the arm loops closest to the buckle. See also FIG. 12. This way, once the arm loops are disconnected, there is no or little structure of the arm loops left behind to dangle or get in the user's way. It will be understood that snap-disconnectors 453, and the cooperating members (not shown) with which they mate, are of the type known in the field of strap connectors as "side-release buckles". It will be understood from FIG. 19 that said cooperating members are attached to the buckle 420, or to the harness very close to the harness, for example, within less than about 0.5 inches of the buckle in FIG. 19. In certain embodiments, other detachable connections may be used in the place of snap-connectors 453 and/or near the location shown for the snap-connectors 453.

Therefore, it will be understood from this disclosure, and also from FIGS. 9-15, that various operative connections may be used for the arm loops. The operative connections may be permanent, semi-permanent, or detachable, as long as the force that 1) lifts/raises the arm loops and hence the buckle, or 2) lifts/raises the harness at or very near the buckle and hence the buckle, and that consequently lifts/raises the central lifter strap, does not disconnect the arm loops from said buckle or harness. The operative connection, therefore, must be a strong and reliable one, for example, strong and reliable stitching, rivets, grommets, clips, hooks, latches, snaps, ties, buckles, or other strong and reliable fasteners. Hook-and-loop fastening material may not in all embodiments be sufficiently and reliably strong enough to withstand said lifting forces.

Figure 20:
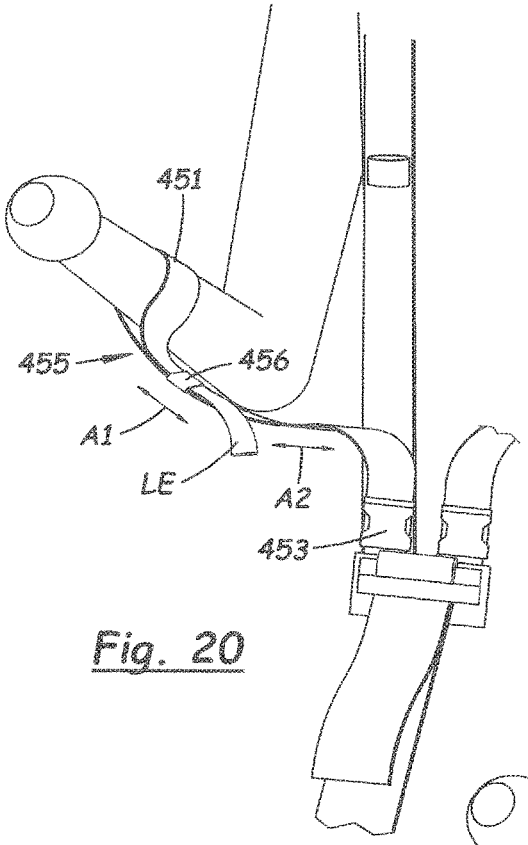
FIG. 20 is a partial, front perspective view of an alternative embodiment of a lifter system worn by a user, wherein the illustrated arm loop is detachably connected to the central buckle or to the shoulder harness very close to the central buckle, and the arm loop is adjustable to adjust the arm aperture diameter and/or the distance of the arm aperture from the location of connection to the buckle/harness.
Figure 21:
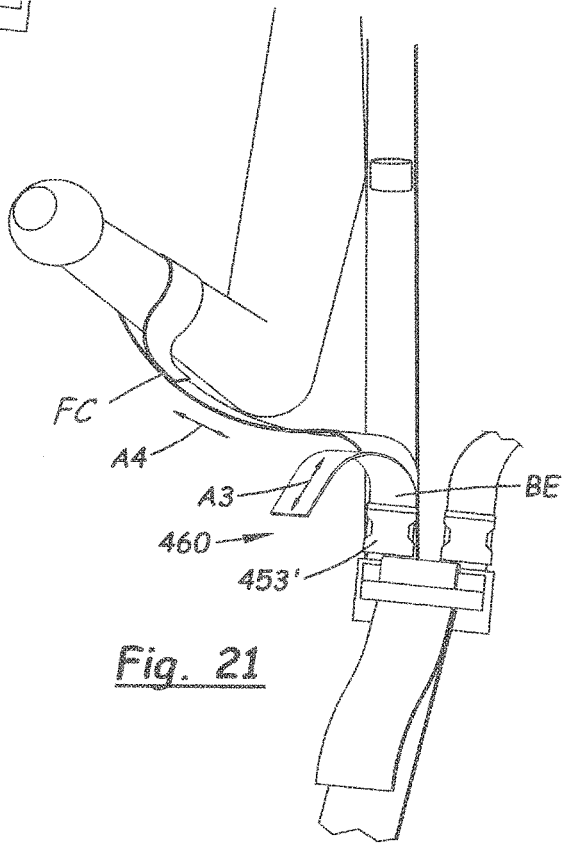
FIG. 21 is a partial, front perspective view of an alternative embodiment of a lifter system worn by a user, wherein the illustrated arm loop is detachably connected to the central buckle or to the shoulder harness very close to the central buckle, and the arm loop is adjustable at the connector to adjust the distance of the arm aperture from the connector.
Figure 22:
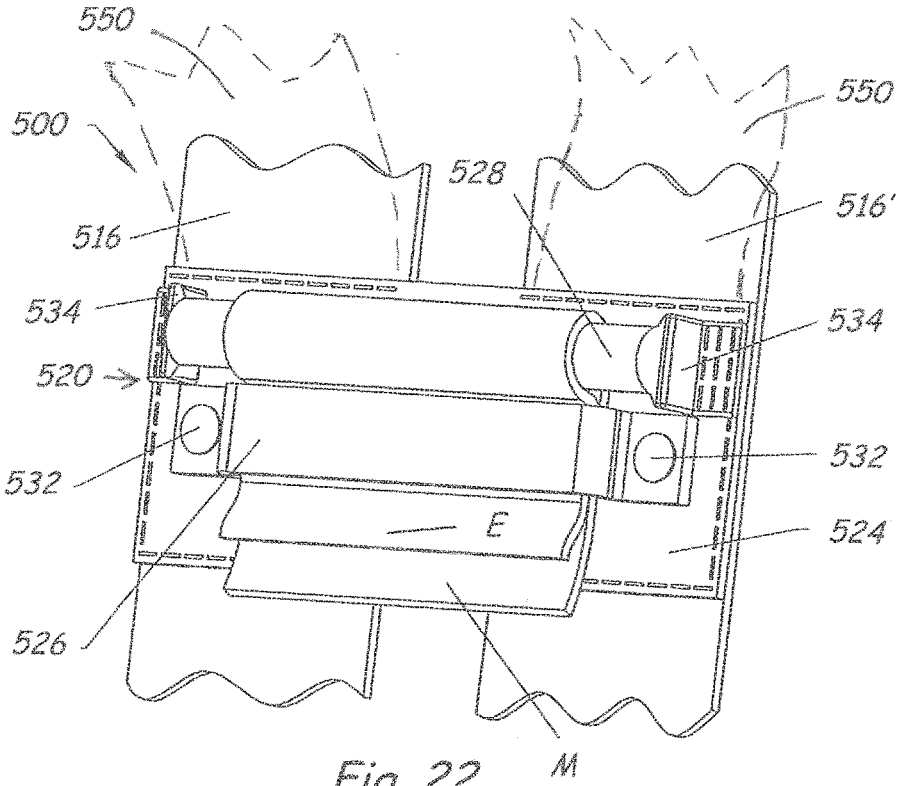
FIG. 22 is a front perspective view of an alternative embodiment of a central buckle that is usable with various embodiments of a shoulder harness and arm loops, wherein a central lifter strap is shown captured in the buckle, and arm loops are shown in dashed lines so the buckle may be fully viewed.
Figure 23:
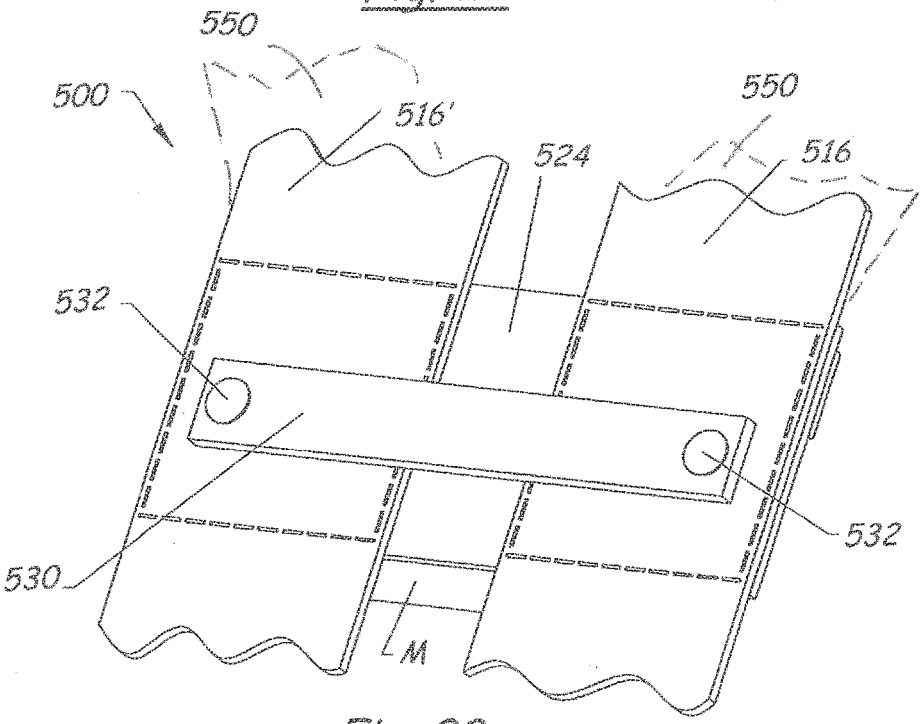
FIG. 23 is a rear perspective view of the embodiment of FIG. 22.

Further, the arm loops, or their connections to the buckle or harness, may be adjustable. For example, as illustrated by FIGS. 20 and 21, adaptations for adjustability may comprise adjusting the diameter of the preferably sole arm aperture, and/or adjusting the length of one or more portions of the arm loop to adjust the distance the arm aperture is from its connection to the buckle/harness. Therefore, certain embodiments of arm loops, whether or not they are detachable and whether or not they are stowable, are adjustable in total arm loop length, for different users and different tasks, including for lifting to platforms, truck-beds, loading docks, landings, and other surfaces of various heights. It is very desirable to be able to adjust the length of the arm loops in advance of lifting, but the preferred systems are adapted so that the user need not necessarily remove his/her arms from the arm loops to do so. Certain of the adjustment systems, therefore, allow the user to grasp the fastener/adjuster, and/or the strap(s)/end(s) fastened/held therein, to do the adjustment while the harness system is on the person and/or while the arms are in the arm loops. Incremental adjustment of arm loop length may be done, for example, by providing multiple hole-and-pin, latches, or connectors on the arm loop proximal end. Continuous adjustment of arm loop length may be done, for example, by providing one or more sliding or continuously-adjustable fasteners/adjustors (that is, non-incrementally along a certain length of the arm loop strap). It is desired that the arm loop apertures or "arm loop ring" be large enough for a user to comfortably slide at least his hands and forearms into and through the apertures of the arm loops. Preferably, the aperture/ring of each arm loop, in use, encircles the forearm of the user, but there may be multiple positions for the aperture/ring of the arm loop that are comfortable and effective for the wearer.

The adjustment system 455 in FIG. 20 for the arm loop is adapted for pulling the end LE of the strap to be closer to the connector 453, and hence closer to the central buckle, and anchoring/fastening the end LE at that position/length. This, in effect, shortens the total length of the arm loop as measured from its connection (453) to the central buckle (or to the harness near the buckle) to the farthest extremity of the single loop 451 for receiving the forearm. Note that schematic FIG. 20 illustrates how both the strap end LE (at arrow A1) and the main portion of the strap of the arm loop (at arrow A2) can be slidable/adjustable in or relative to a fastener/adjuster 456, for adjustment of the overall arm loop length in effect by moving the single loop 451 closer to the central buckle. This adjustment is one example of an adjustment system that may also comprise, or that may be used instead for, changing the diameter of the single loop 451, if desired, as will be understood from the drawing in view of fastener/adjuster 456 being a non-fixed attachment forming the strap into a single loop 451.

The adjustment system 460 in FIG. 21 for the arm loop is adapted for pulling/adjusting the opposite strap end BE (or the strap's "buckle end"), which is at or near the central buckle, and anchoring/fastening strap end BE at that position/length. This, in effect, shortens the total length of the arm loop as measured from its connection to the buckle (or to the harness near the buckle) to the farthest extremity of the single loop for receiving the forearm. Note that schematic FIG. 21 illustrates how both the strap end BE (at arrow A3) and the main portion of the strap of the arm loop (at arrow A4) can be slidable/adjustable in or relative to the adjustable snap-disconnect connector 453' for adjustment of the overall arm loop length, in effect by shortening the region of the arm loop strap between the single loop and the central buckle. It may be understood that connector 453' is designed to both detachable connect the arm loop to the buckle/harness, and to slidably adjust the strap of the arm loop through the connector 453' and to also grip/fasten the strap of the arm loop once the adjustment has been made by a user. Those of skill in strap adjusting and gripping/fastening will understand that various adjustors and fasteners, instead of or in addition to the device numbered as 453', can be used to adjust the overall length of the arm loop. The adjustment in FIG. 21 is an example of a length adjustment that will not change the diameter of the single loop, as will be understood from the drawing in view of the fixed attachment FC of the strap into a single loop.

Note that length adjustments as discussed herein and as will be understood from this discussion, are the preferred way of adapting arm loops for various users and various loads and situations. It is preferred that only a single loop or other single aperture is provided in the arm-operated apparatus for each of the user's hands/arms, as such a simple and effective arm loop structure is especially effective and safe and easy to use, especially when the length of the arm loop structure, and/or the single loop/aperture diameter, may optionally be adjustable. In many embodiments, the arm loops described herein each have an arm-receiving structure or distal end that consists essentially of, or consists only of, a single loop or a single aperture for receiving an arm.

FIGS. 22-28 and FIGS. 29-31, portray central buckles 520 and 620, respectively, as examples of detail for constructing buckles such as the schematically-drawn central buckles 220, 320, 420 in FIGS. 16-21. Central buckles 520 and 620 and their operation and use will be understood from discussion above in this document, from the discussion of FIGS. 22-28 and FIGS. 29-31 below, and also from Applicant's U.S. Pat. Nos. 8,807,403 and 9,101,202, which are incorporated herein by this reference.

Figure 24:
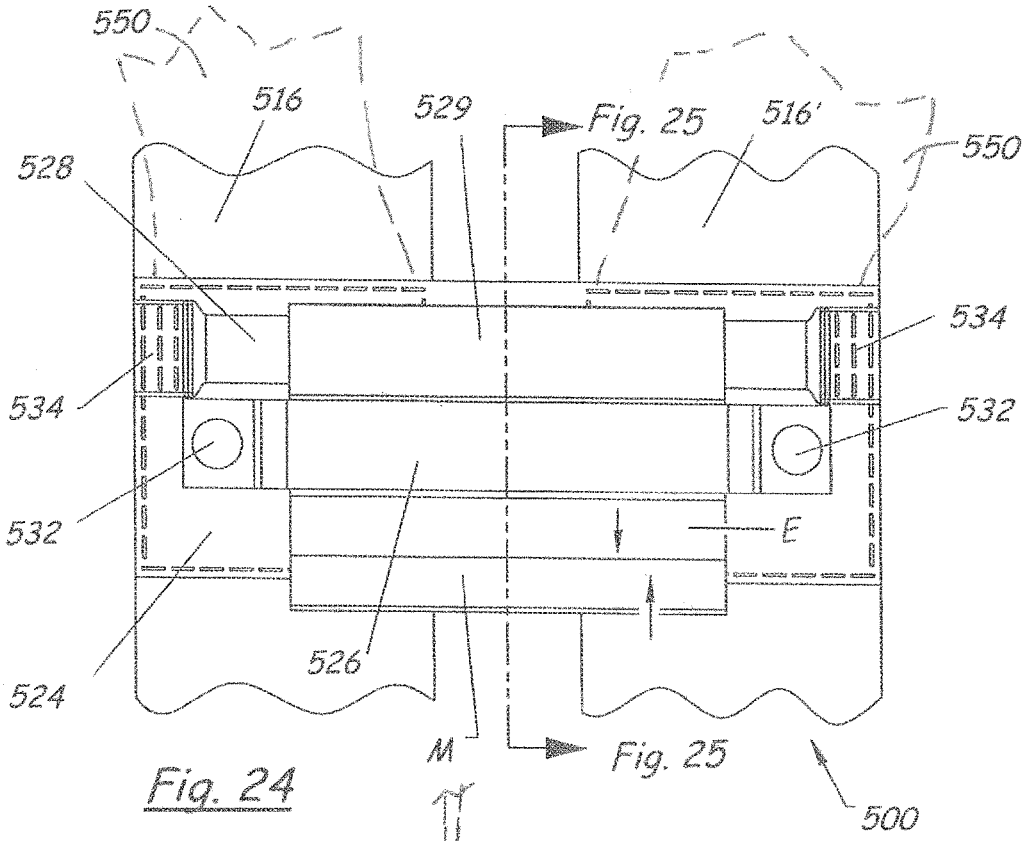
FIG. 24 is a front view of the embodiment of FIGS. 22 and 23.
Figure 25:
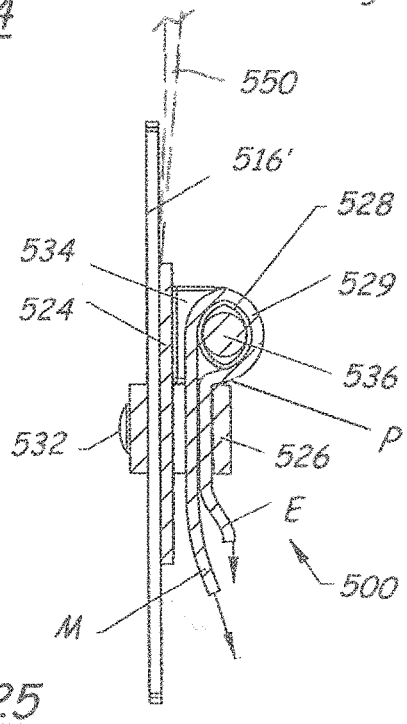
FIG. 25 is a cross-sectional view of the embodiment of FIG. 24, viewed along the line 25-25 in FIG. 24.
Figure 26:
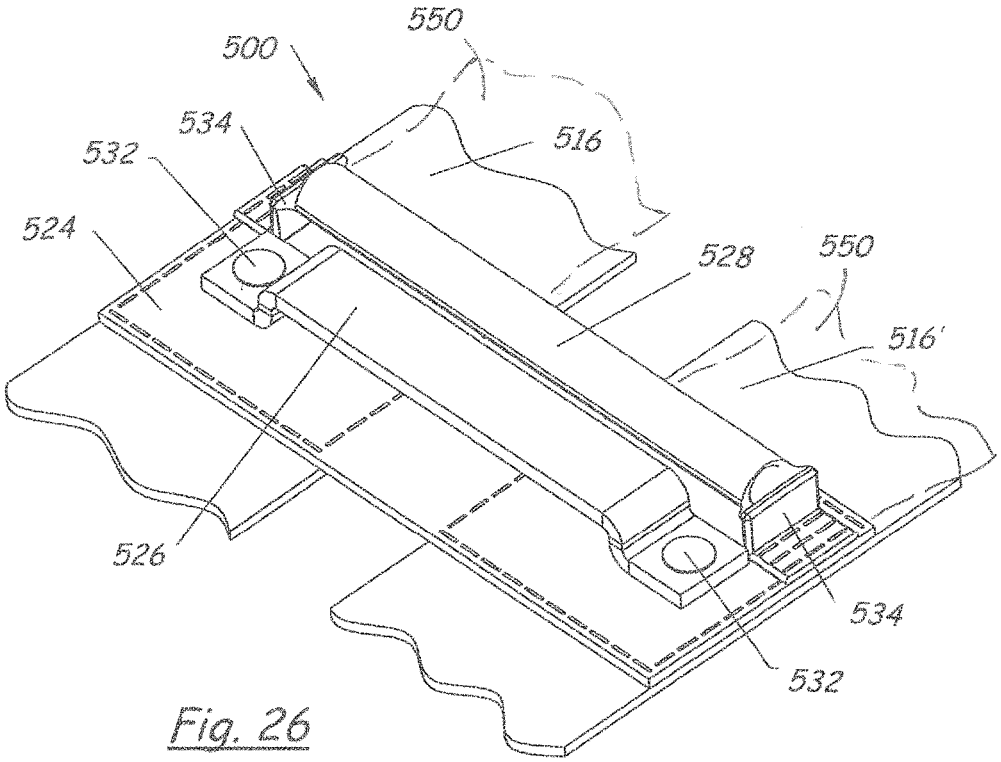
FIG. 26 is a front perspective view of the buckle of FIGS. 22-25, shown with the central lifter strap removed.
Figure 27:
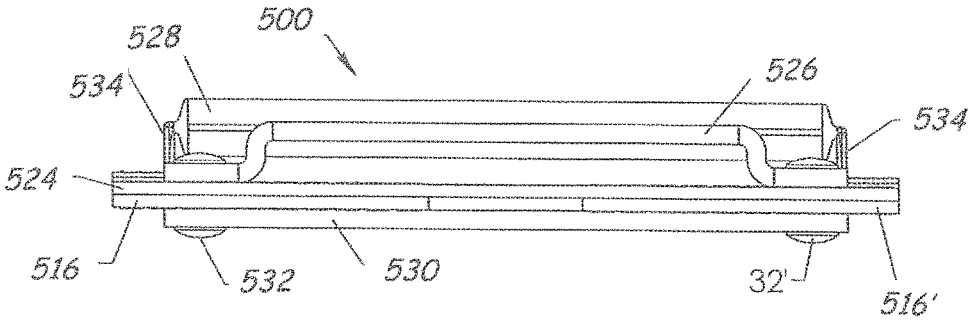
FIG. 27 is a bottom view of the buckle of FIG. 26.
Figure 28:
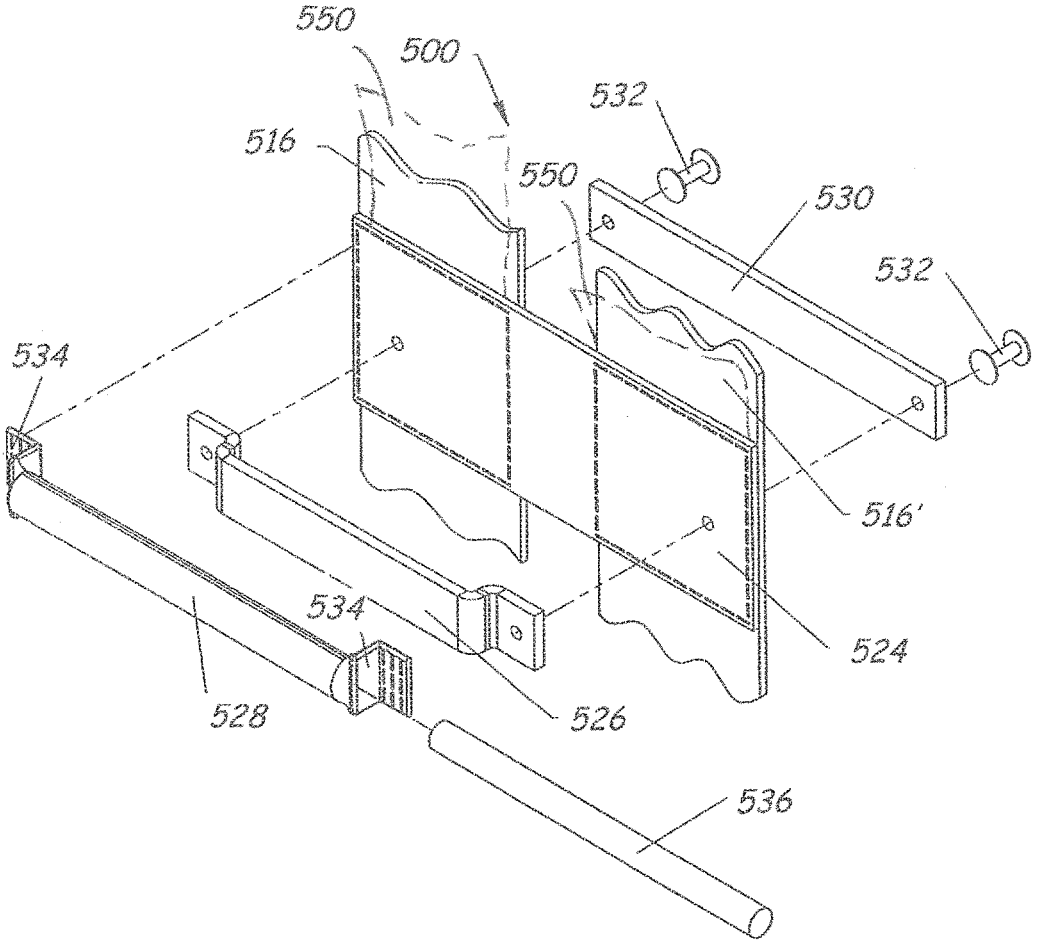
FIG. 28 is an exploded front perspective view of the buckle of FIGS. 26 and 27, without any central lifter strap.

FIGS. 22-25 are partial views of lifter system 500, which has shoulder loops 516, 516', central buckle 520, arm loops 550, and central lifter strap portions E and M. FIGS. 26-28 are a side perspective, bottom, and side perspective exploded view, respectively, of the lifter system 500, without central lifter strap installed in the buckle. The arm loops 550 are shown partially, and in dashed-lines, so the buckle 520 and harness straps may be fully-viewed, and also as an indication that the arm loops may be of various types and the connection to this lifter system 500 may be done in various ways.

In lifter system 500, a short buckle strap 524, reinforced with a rigid plate 530, forms the "back-plate" or "main-body" of the buckle 520. A fixed, rigid lower loop or bar 526 extends horizontally across and is spaced from the front surface of the buckle back-plate/main-body, and a flexible or otherwise movable upper loop 528 also extends horizontally across and is spaced from the front surface of the buckle back-plate/main-body, above the rigid lower loop/bar 526. Central lifter strap portion M first passes up through/behind the lower loop 526, then up behind upper loop 528, forward and down in front of upper loop 528 for form bar-encircling strap portion 529 before passing down through (behind) lower loop 526 again and exiting the buckle 520 as strap portion E. In other words, one may describe the central lifter strap as extending twice (or two portions extending) through the lower loop 526, in order to extend over (partially around) movable/flexible upper loop 528.

The arrows on the strap main portion M and the end portion E, in FIG. 24, illustrates how the strap may be adjusted in the buckle to shorten the length of the main portion M, that is, the portion that extends from the buckle, under the lifted object, and, typically, to the buckle of another lifter harness. Alternatively, if the user deems that the main portion M is not sufficiently long for the lifting job, the action would be reversed (and the arrows on portions M and E in FIG. 24 would therefore be reversed) to length main portion M. These adjustments would be done when the upper loop 528 is lifted/spaced from the lower loop 526 sufficiently to slide the strap between them. Upon completing this adjustment, the strap portion(s) M and/or E may be pulled down, as illustrated by the arrows on portions M and E in FIG. 25, to pinch the strap between the upper and lower loops 528, 526, at pinch location P.

The fixed ends of the rigid lower loop 526 are secured to short buckle strap 524 by rivets 532, and, preferably, the entire lower loop 526 is inflexible and is immovable relative to the buckle strap 524 and relative to the upper loop 528. On the other hand, the upper loop 528 may be entirely or partially flexible, but is preferably flexible only or substantially only at its ends. For example, this may be accomplished by providing a member that has flexible ends and/or is flexibly connected to the buckle strap 524 or other back-plate/main body of the buckle. This may be accomplished by providing a flexible member that flexes at its ends, but is reinforced at its central region, to be less flexible and/or inflexible at said central region. Or, this may be accomplished by providing a member that comprises multiple materials so that it is flexible at its ends but relatively more rigid at its central region. Or, this may be accomplished by providing a member that is rigid but is connected to the back-plate/main-body of the buckle by a flexible connector, for example, rubber or cloth connector fixed to both the ends of the rigid member and the back-plate/main-body. In certainly embodiments, upper loop 528 is made of strong, fabric that flexes and bends easily at both its ends but is reinforced at its central region by an inserted or attached rigid tube(s) or bar(s).

Upper loop 528 and lower loop 526 need to be spaced so that the central lifter strap may be conveniently pushed between the loops to be threaded through the buckle. If upper loop 528 is made of thicker, softer material, for example, the bottom, or a portion of the bottom, of upper loop 528, may lightly touch the top of lower loop 526, even with no load applied to central lifter strap. Due to the flexibility of the upper loop 528, however, a user may easily lift upper loop 528 away from lower loop 526 to space the two loops 526, 528 for threading the lifter strap through the buckle.

FIG. 24 shows a front view of lifter system 500. In this Figure, the flexible ends 534 of upper loop 528 are clearly shown, stitched to the front of short buckle strap 524. FIG. 25 shows embodiment 500 in side cross-section along the line 25-25 in FIG. 24, so that the reinforcement rod 536 is visible within the flexible web/cloth tube of flexible upper loop 528. Preferably, rod 536 is made of a rigid and strong material like metal, wood or plastic. Also, from FIG. 25, it is clear that the web/cloth of the loop 528 flexes and changes shape to become more oval than round to help pinch central lifter strap against itself and the top edge of rigid lower loop 526 to secure the lifter strap in the buckle. Also, because the ends 534 of upper loop 528 are also flexible, when a load is applied to lifter strap, the central region of upper loop 528 is pulled down relative to lower loop 526 to become closer to lower loop 526, which also assists in the pinch pressure on lifter strap.

Thus, it may be understood from the drawings, that, while the main body of the flexible upper loop 528 (for example, a web/cloth tube) may be flexible material, the reinforcement rod 536 inside the main body keeps a central region/portion of the loop 528 in a straight or substantially straight form, that is, preventing any, or alternatively preventing significant, bending or flexing of that central region/portion. Thus, in FIG. 25, the central region/portion of loop 528 lies generally straight due to the rod 536, but the web/cloth of the loop 528 optionally is pulled to be oval in cross-section. The portions of the loop 528 that are not reinforced, preferably the flexible ends 34, 34', flex to allow the central strap to pull the central region/portion of the upper loop 528 toward the lower loop 526 to pinch the lifter strap there-between. The forward portion of the lifter strap (end E) is typically pinched at location P in FIG. 25.

Figure 29:
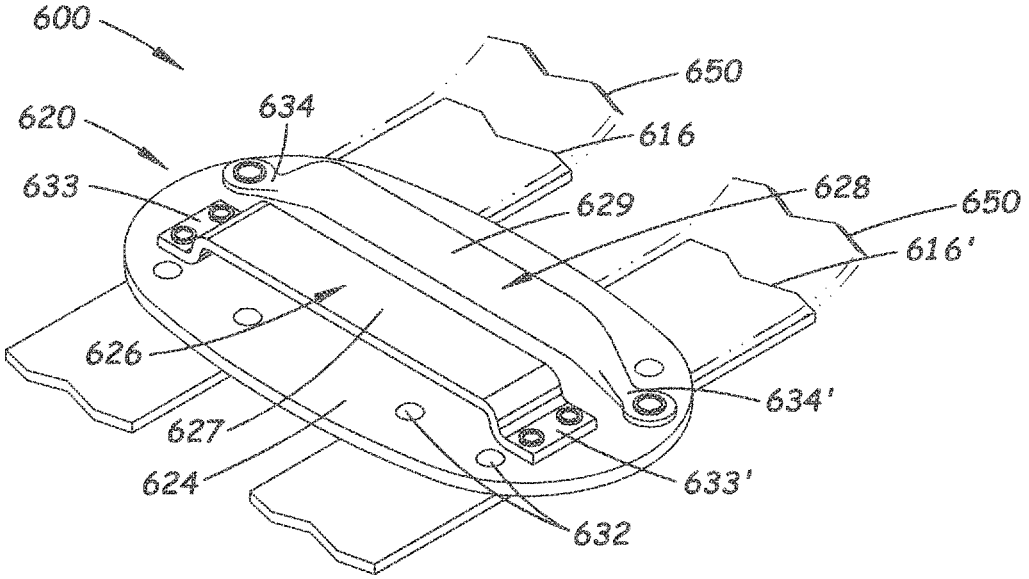
FIG. 29 is a front perspective view of another embodiment of a central buckle that is usable with embodiments of a shoulder harness and arm loops, wherein arm loops are shown in dashed lines so the buckle may be fully viewed.
Figure 30:
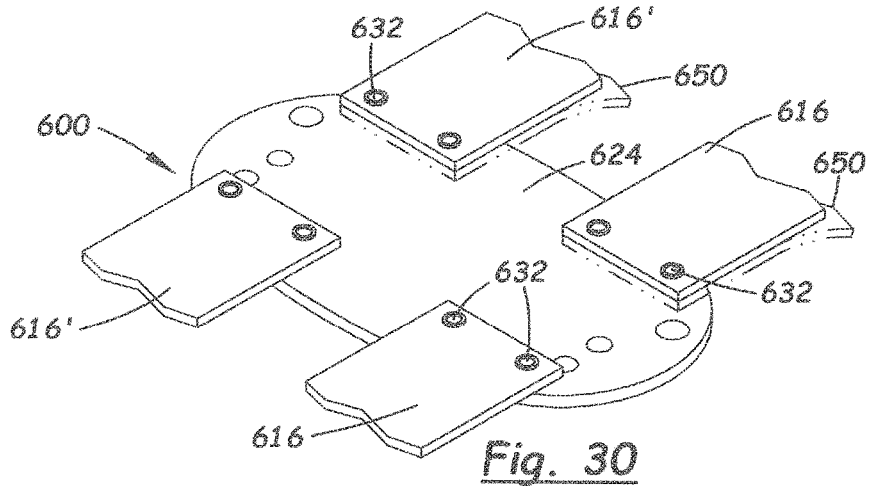
FIG. 30 is a rear perspective view of the central buckle of FIG. 29.
Figure 31:
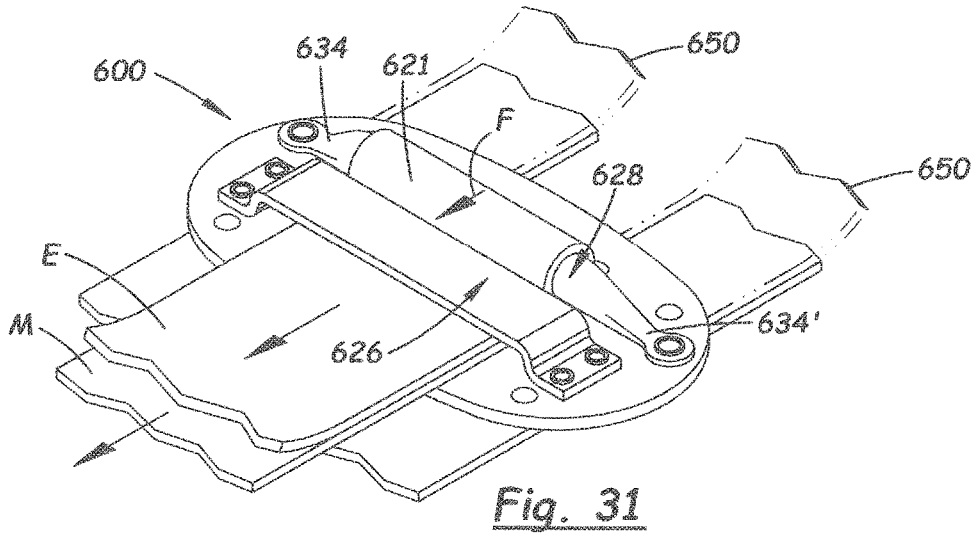
FIG. 31 is a front perspective view of the central buckle of FIGS. 29 and 30, which is shown with a central lifter strap being captured in the buckle.

FIGS. 29, 30, and 31 illustrate the central, front portion of an alternative lifter system 600, comprising central buckle 620 that has many/most features in common with, and may be used the same or similarly as, buckles 220, 320, 420, and 520. Buckle 620 illustrates certain alternative materials and connection means. A back-plate 624 is connected to straps 616, 616', which may be shoulder harness straps, by rivets or other fasteners 632. The back-plate 624 may be formed of rigid polymer, metal, composite, or other durable and preferably non-bending material(s). The shape of the back-plate 624 as drawn is oval or oblong, but it may be other shapes, for example, rectangle, round, or polygonal. The lower loop 626 is a rigid bar/plate that is bent/formed and attached at its ends 633 and 633' to the back-plate 624 so that the central portion 627 of the loop 626 is spaced from the front surface of the back-plate 624. The upper loop 628 is parallel or generally parallel to the lower loop 626 and also attached as its ends 634, 634' to the front surface of the back-plate 624, so that the central portion 629 of the loop 628 is spaced from the front surface of the back-plate 624, as discussed above for other embodiment(s) and for the same reason(s) as discussed above. The central portion 629 of upper loop 628 is rigid or substantially rigid, for example, due to the central portion 629 being formed of a rigidity/density, and/or comprising reinforcement member(s), that make it rigid, or at least much more rigid than flexible ends 634, 634', so that said pinching occurs reliably and securely, rather than the forces bending or misshaping the upper loop central portion 629 to a condition wherein it does not pinch the central lifter strap or only pinches a small portion of the width of the central lifter strap.

Figure 29A:
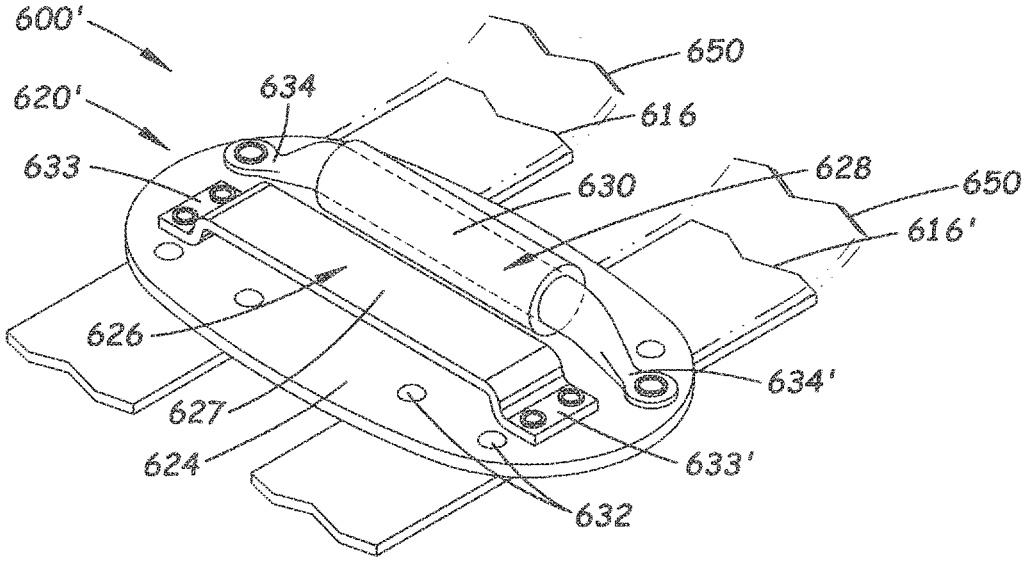
FIG. 29A is a front perspective view of an embodiment like that in FIG. 29, except that a roller sleeve is provided on the upper loop.

FIG. 29A illustrates the central, front portion of an alternative lifter system 600', which is the same as in lifter system 600 of FIGS. 29, 30 and 31, except that a roller sleeve 630 is provided around the upper loop 628 for rotating relative to upper loop 628. Roller sleeve 630 may aid in adjusting the central lifting strap in the buckle 620', by allowing the strap to rotate the sleeve rather than sliding around the upper loop 628, during adjustment of the strap. Said adjustment of the strap in the buckle, to increase or decrease the length of the main portion M that is placed underneath an object to be lifted, is further discussed below regarding FIG. 31. After the central lifting strap is adjusted and pinched between the upper loop and lower loop, the sleeve 630 will no longer rotate.

As shown in FIG. 31, a central lifter strap CS may be "threaded" or "passed" through the lower loop 626, and around the upper loop 628 (see encircling portion 621 extending part way around upper loop 628). Typically, this is done by "threading" an end portion E of the strap through the buckle 620, so that the end portion E of the strap is forward from the main portion M of the strap. As described above regarding FIG. 24, the user adjusts the overall length of the main portion M that is placed underneath an object to be lifted, for example, by holding the upper loop 628 central portion 629 away from the lower loop 626, and adjusting/sliding the strap end E and/or main body M relative to the buckle 620, as needed to adjust what portion of the strap will be captured in the buckle 620. Then, after this adjustment of the strap in the buckle, the user can: 1) tug the strap downward (arrows in FIG. 31 on portions E and M), to tighten the capture by means of portion 621 pulling the upper loop down (see arrow F), via flexible ends 634, 634', to pinch the strap in the buckle, before the user begins lifting the load placed on the central strap (which tends to further tighten the capture of strap in the buckle); or 2) the user may proceed to lift the load placed on the central strap, which tends to automatically and immediately tighten the capture of strap in the buckle, in effect, by the same means of portion 621 pulling the upper loop down (see arrow F), via flexible ends 634, 634', to pinch the strap in the buckle 620.

System 600 also includes two arm loops 650 that are mechanically and operatively connected to the buckle and/or to the harness shoulder straps 616, 616' at a connection at, or very near and above, the buckle 620. As in lifter systems described earlier in this document, the arm loops do not attach directly to the central lifter strap, but rather attach, preferably directly, to the buckle and/or the harness straps at or above the buckle. For example, the right and left arm loops 650 may be fixed to the back-plate 624, as suggested by FIGS. 29-31. Alternatively, the arm loops 650 may be fixed to the shoulder straps 616, 616' of the harness within a short distance from the buckle (e.g. at 0-5 inches, 0-3 inches, or 0-2 inches, above the top end of the buckle 620). This way, the arm loops 650 properly extend upward from the buckle or near-buckle region, so that the arm loops on the user's arms may be lifted up to support the buckle (or the harness straps very close to and above the buckle), and therefore, support some or all of the load that is on the buckle due to the weight on the central lifter main strap portion M). Use and operation using the arm loops is further discussed below.

Figure 39:
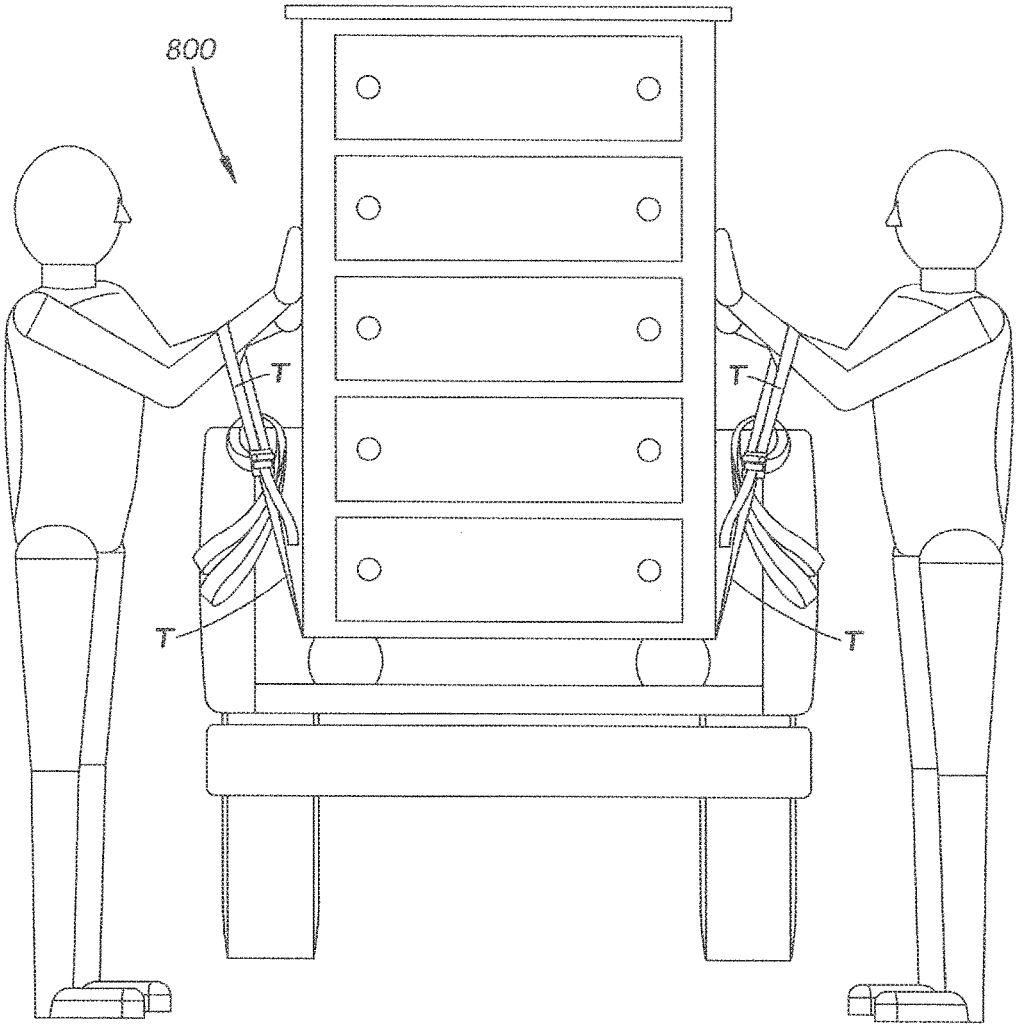
FIG. 39 is a side view of two users using the lifter system of FIGS. 32-38, in an alternative method, by lifting with only the arm loops, and with shoulder loops removed from the shoulders and draped over the buckles in a stowed/stored position.
Figure 40:
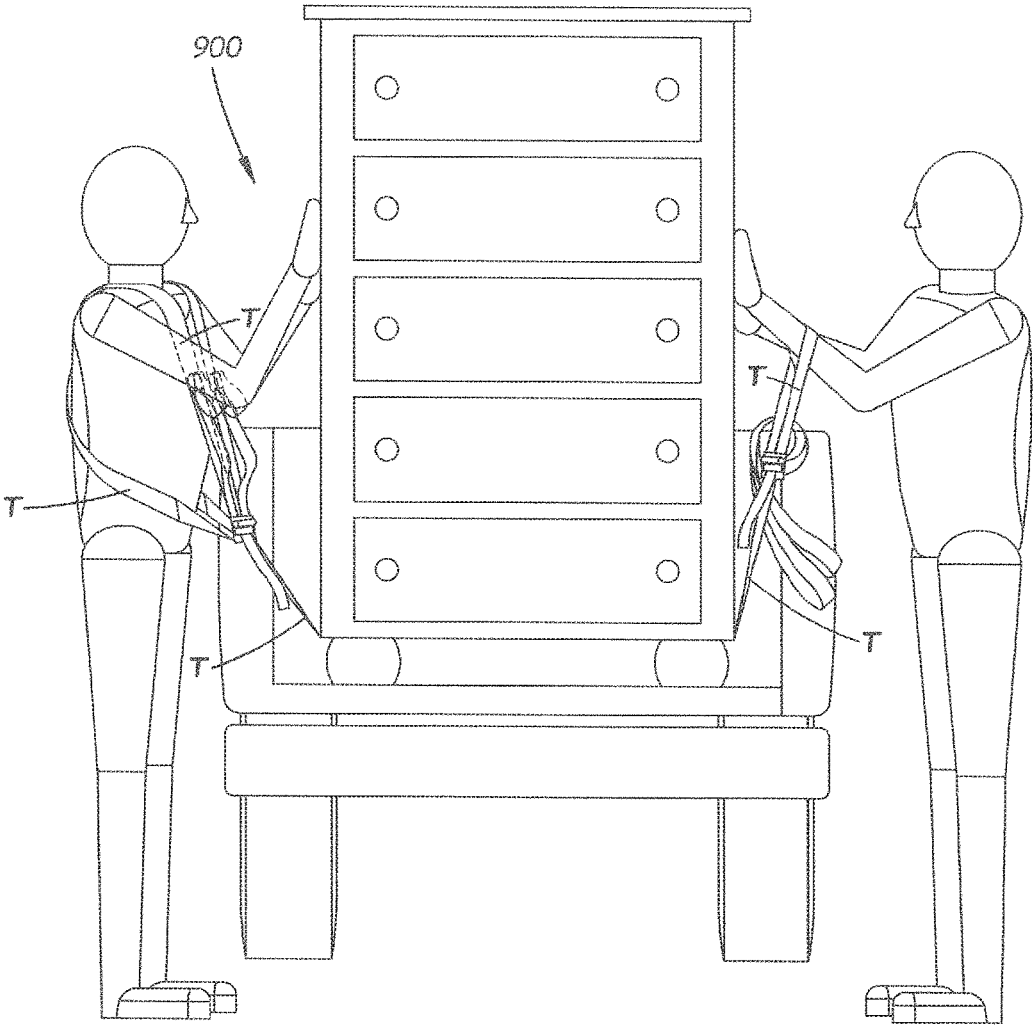
FIG. 40 is a side view of two users using the lifter system of FIGS. 32-38, in an alternative method, wherein one user is lifting with only the arm loops and has stowed the shoulder loops as in FIG. 39, and wherein the other user is lifting only with the harness and has stowed the arm loops.

In use, the lifter system comprising multiple lifting options may be used in various ways, some of which are illustrated by FIGS. 32-40. FIGS. 32-35 illustrate a lifting system and method 700 wherein two people use the harness and also the arm loops for lifting during different steps of the method. FIGS. 36-38 illustrate how the length of the preferred arm loops relates to raising the buckle, and hence the central strap, above the level accomplished with only the harness. FIG. 39 illustrates two people using a method 800 wherein only the arm loops of the lifter system are used. FIG. 40 illustrates a method 900 wherein one person uses only the harness, with arm loops stowed, and the other person uses only the arm loops, with the harness stowed.

Referring more specifically to FIGS. 32-35, two people are shown cooperating to lift and maneuver a lifted object LO, wherein each person wears both harness and arm loops of the lifter system embodiment 700, so that the harness and the arm loops are available for different steps of the method.

Figure 32:
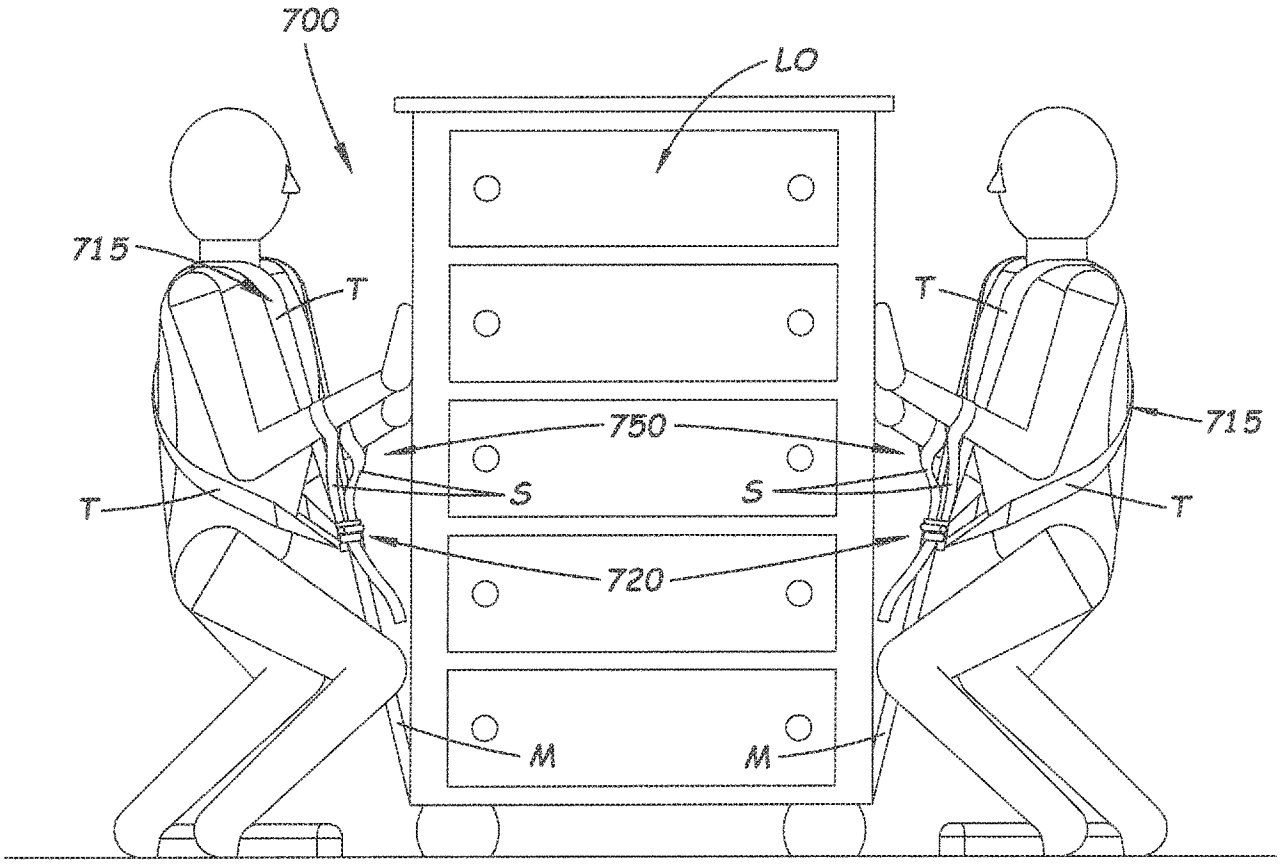
FIG. 32 is a side view of two users using an embodiment of the lifter system to lift a dresser, wherein each harness has two arm loops that are slack because the users have just started to lift the dresser by applying shoulder- and torso-lifting force rather than arm loop force.

As shown by FIG. 32, the lifter system 700 may be used to lift the lifted object LO entirely (and solely) with the central lift strap 20 main portion M, via the buckles 720 and harness 715, rather than with supplement force via the arm loops, in which case the arms in or out of the arm loops 750 can stabilize the lifted object LO but not bear any of the weight (or any significant part of the weight) of the lifted object LO. In FIG. 32, note that the arm loops 750 are slack (see slack areas S) and not carrying any of the weight of the strap main portion M or the lifted object LO; instead, the harnesses 715 are taught (see T in FIG. 32) and the strap M and buckles 720 are pulling down the front of the harnesses 715 under said weight.

Figure 33:
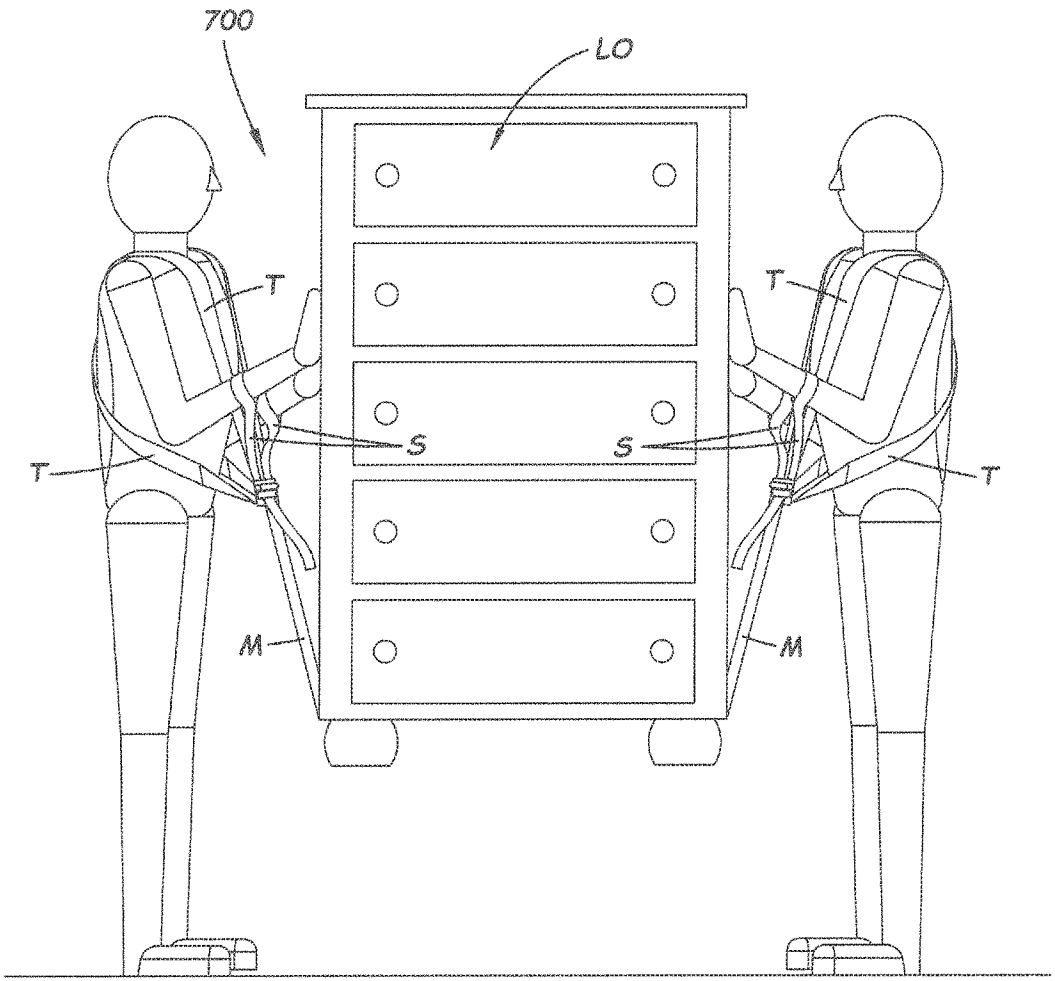
FIG. 33 is a side view of the two users and the lifter system of FIG. 32, wherein the users have stood up and the users are carrying the weight of the dresser via the central lifter strap and shoulder harnesses (via shoulder- and torso-lifting force), rather than via the arm loops.

In FIG. 33, the users have stood up straight, but there is little or no change in the position of the arms and arm loops relative to the buckles 720 and the lifter strap M, and the arm loops are still slack (see slack S). Thus, the weight remains on the strap main portion M, the buckles 720, and the harnesses, and hence on the users' shoulders and back. While the users are stabilizing the lifted object with their hands, for example, by the hands pushing forward on the lifted object, the arm loops in FIG. 33 are still slack (S) and are not carrying weight of the lifted object LO. Even though the arm loops 750 are around the users' arms, in FIG. 32, the users have chosen not to lift their arms to the extent wherein the arm loops 750 would be taught and would be holding/carrying at least some of the weight of the buckles/strap/lifted-object. In such an operation, the users could opt to remove their arms from the arm loops or optionally detach the arm loops from the system 700, but it is preferred to retain the arm loops on their arms for the case/time when the arm loops are needed/desired to share part or all of the load, as is illustrated in FIGS. 34 and 35.

Figure 34:
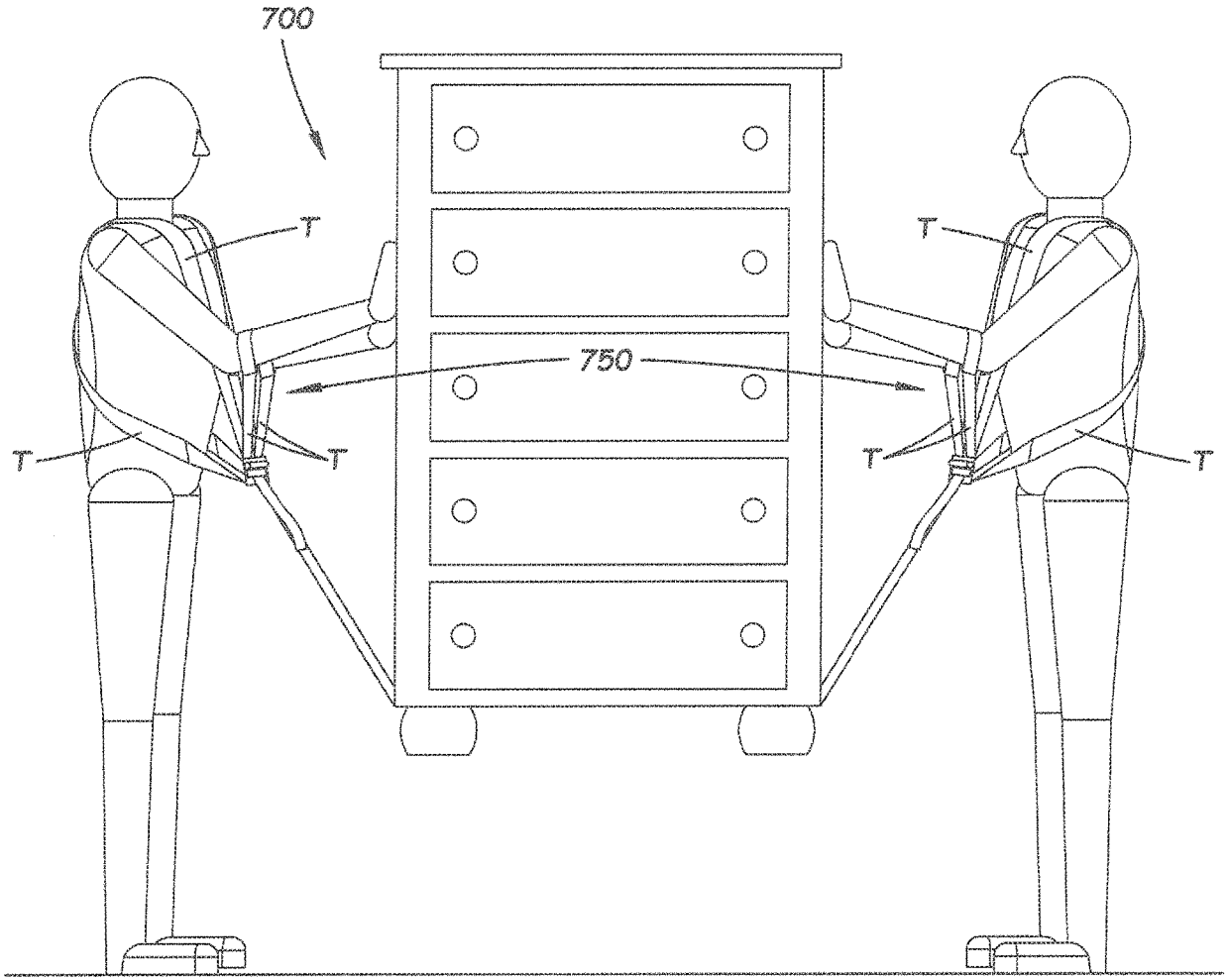
FIG. 34 is a side view of the two users and lifter system of FIGS. 32 and 33, but wherein the users are carrying the weight of the dresser via the central lifter strap by shoulder- and torso-lifting force via the shoulder harness, and also by arm force via the arm loops (via raised forearms and consequently taught arm loops).

In FIG. 34, the users are standing up straight and have chosen to position themselves farther from the lifted object, and to lift their arms, to an extent that the arm loops 750 as well as the harnesses are taught (see T), and are carrying some of the weight of the lifted object LO via their connection to the buckles or to the harnesses near and above their respective buckles. Thus, in FIG. 34, the weight of the lifted object is carried via two systems that carry the buckles (here, both the harness and the arm loops of each user) and so one may say that the load is shared by the two systems.

Figure 35:
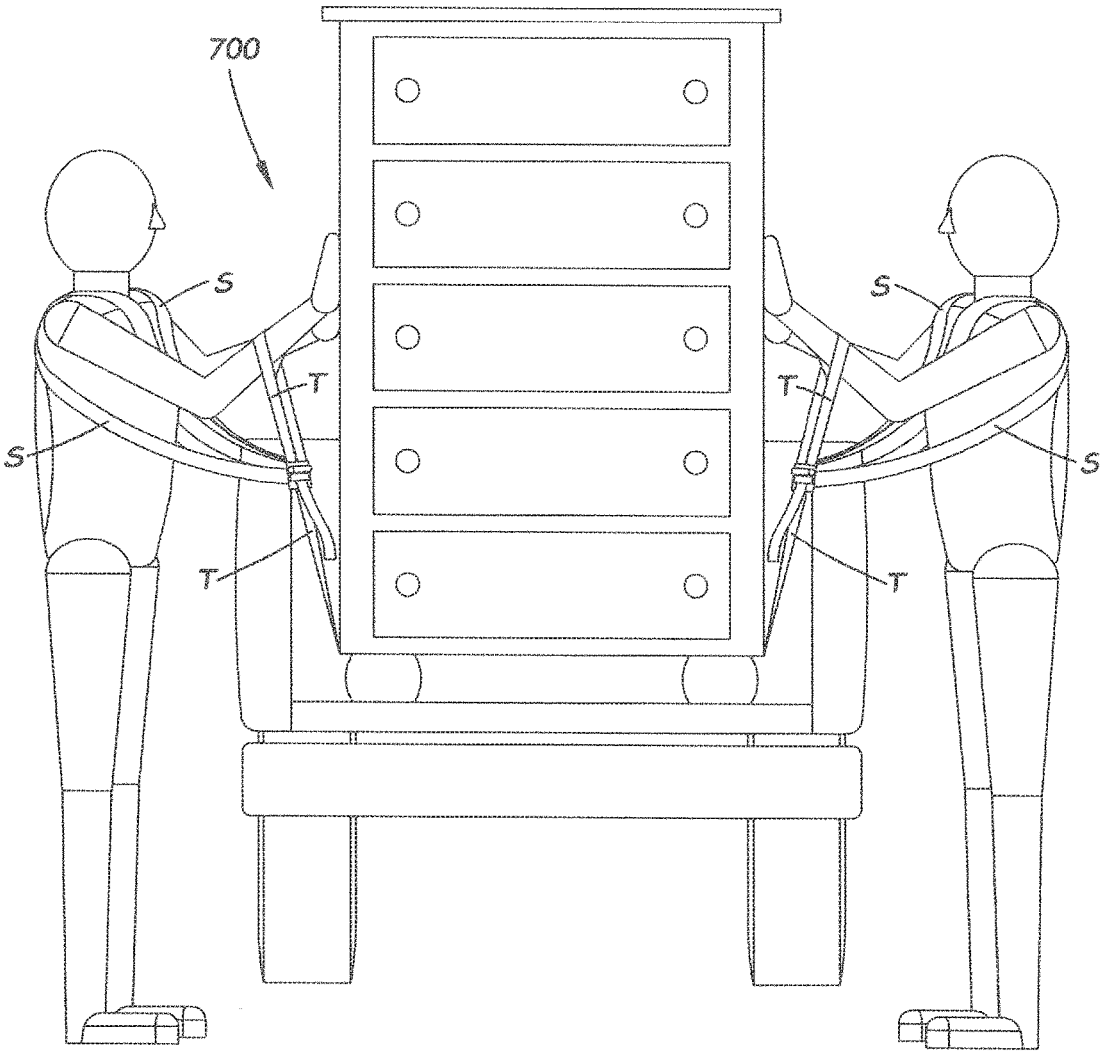
FIG. 35 is a side view of the two users and lifter system of FIGS. 32-34, wherein the users have raised their arms higher and straight, and therefore have raised the arm loops higher, to pull the buckle, the central lifter strap, and hence the dresser, higher than possible without the arm loops, to place the dresser in a truck bed. Note that the taught arm loops are in straight line with the buckle and with the upper end of the central lifter strap (between the buckle and the bottom of the lifted object), and that the harness shoulder loops are slack, because the lifting force is provided solely by the arms via the arm loops.

In FIG. 35, the users have lifted their arms further as they lift the object LO up high into a pickup truck bed. This technique may be very useful for lifting to relatively high locations, such as a truck bed, a loading dock, or a landing that requires more feet of lift than possible with the lifter strap and shoulder harnesses alone. The extra leverage, power, and beneficial positioning and control afforded by the arm loops can make the system/device optimal for an increased number of scenarios and users, including for shorter people or people who are more comfortable using their arm strength than mainly or only their leg and shoulder/torso strength. This places the weight entirely on the arm loops rather than on the harness, as can been seen by the taught T arm loops raising the buckles, and the harnesses being slack S. The arm loops, therefore, allow the users to lift their respective buckles, and hence the strap main portion M and the lifted object, higher than if only the shoulder harnesses are used, due to the arms being raisable far above the lower belly/torso of the users where the buckles reside when supported only by the harnesses. During this operation, the hands of the users, even in FIG. 35, can still stabilize the lifted object, while the arms are also supporting a lot of weight via the arm loops. It may be noted that the length of the arm loops, the buckle, and the length of the upper end of the central lifter strap (that is between the buckle and the bottom of the lifter object), are in a straight line due to the lifting forces being entirely along that line. The resulting tautness T of the arm loops and said upper end of the central lifter strap may be noticed, as well as the slackness S of the shoulder harnesses.

FIGS. 36-38 further illustrate how the users' arm positioning, and the length of the arm loops, affect whether the arm loops carry weight and what part of the weight they carry. FIG. 36 is a side, detail view of the lifter system of FIGS. 32-35, wherein the user has stood up straight, with arms positioned so that the arm loops are slack, as in FIG. 33. The level of the buckle ("original buckle level" OL) above the ground G, shown as a dashed line, is the highest level possible given the height and stature of the user, the dimensions of the taut harness T and where the buckle is attached to the harness, and the slack arm loops S. A dashed line "shoulder-buckle-forearm triangle" is also drawn in FIG. 36, wherein the triangle sides are various distances of particular interest here, that is, the distance between the shoulder point of the harness (top of shoulder, typically uppermost part of the harness) and the buckle, which is called the "length of the harness", the distance between said shoulder point and the upper end arm loop point (drawn as the center of the arm loop aperture, generally corresponding to the center of the forearm), and the distance from the arm loop point to the buckle. One may see in FIG. 36 that this triangle has two small, very acute angles at the shoulder point and at the buckle, and a third, obtuse angle at the arm loop point that is much larger than said two small angles, due to the position of the arms not pulling the arm loops to extend their full length straight away from the buckle.

FIG. 37 shows a side view of the system and user of FIG. 36, wherein the user has raised his arms to pull the arm loops to their full length, which lifts the buckle and allows the harness to go slack, as in FIG. 35. The level of the buckle is higher than original level OL, and consequently the upper end of the lifter strap and the lifted object are higher than in FIG. 36. The dashed line triangle in FIG. 37 illustrates a lengthening of the distances between the arm loop point and the buckle, and between the arm loop point and the shoulder point due to the forearms moving up and forward. One may see in FIG. 37 that this triangle has larger acute angles at the shoulder point and at the buckle, and a smaller obtuse angle at the arm loop point, compared to the angles of the triangle of FIG. 36.

FIG. 38 illustrates the user raising his arms even higher than in FIG. 37, to pull the buckle up even higher above the original level OL than in FIG. 37. The arm loops are still taut and doing the lifting, and the shoulder harness remains slack. Note that the dashed line triangle has two larger acute angles, and a smaller obtuse angle (reduced almost to 90 degrees), compared to the triangle in FIG. 37. One may say that the arms have pivoted at the shoulder to extend above horizontal in FIG. 38.

From FIGS. 36-38, it will be understood that the user may control lifting, by means of the arm loops, of the object above the floor/ground or other surface on which the user stands, by his/her arm placement/angle and optionally by adjusting the length of the arm loops. One may understand from FIGS. 36-38 that shorter arm loops, either by original design or by length adjustment, could pull the buckle and hence the upper end of the central lifter strap and the bottom of the lifted object to a higher position relative to the ground. Also, one may understood that longer arm loops, either by original design or by length adjustment, would pull the buckle, and hence the upper end of the central lifter strap and the bottom of the lifted object to a lower position relative to the ground. Thus, if the arm loops are designed or adjusted to be too long, lifting the arms will be less effective in lifting the object than with shorter arm loops. For example, if the arm loops are as long as the distance from the arm loop point to the original level OL in FIG. 38, the buckle will not be lifted above level OL unless the user lifts him arms much higher than horizontal, making the lift uncomfortable and/or difficult. Thus, the length of the arm loops should be predetermined and/or adjusted to be short enough that arm lifting causes significant lifting of the buckle above the level at which it would be located when simply hanging from the shoulder harness. Preferably, the arm loops are shorter in length, or adjustable to be shorter in length, than the distance from the uppermost extremity of the harness to the buckle of the harness; this ensures that lifting the arm loops will lift the buckle higher than the buckle would be when lifted/supported only by the shoulder harness. Preferably, the arm loops are shorter, or adjusted to be shorter, than said distance by at least 20 percent, and more preferably by at least 30 percent, and most preferably by 30-70 percent.

FIG. 39 illustrates an alternative method 800 of using a lifter system according to certain embodiments of the invention, wherein the users have chosen to use only the arm loops, but not the shoulder harnesses. Each harness is portrayed as draped over the buckle to be out of the way. Alternatively, disconnectable connectors (not shown) may be incorporated into the straps of the shoulder harness, to allow the shoulder harness portions/loops to be detached from the buckle-and-arm-loop combination, for such methods of use.

FIG. 40 illustrates an alternative method 900 of using a lifter system according to certain embodiments of the invention, wherein the two users have chosen to use different portions of the lifter system and, consequently, different modes of lifting and/or maneuvering the object. The person at the right is using arm loops only, while draping the shoulder harness over the buckle as in FIG. 39. The person at the left is using the shoulder harness only, while stowing the arm loops out of the way at/against the shoulder loops, for example, in stow loops 252 such as shown in FIGS. 16 and 17.

While not shown in a single Figure, it will be understood from FIGS. 32-35, 39 and 40, that other combinations of the system portions and other methods may be used. For example, one person may use both arm loops and harness (as in FIGS. 32-35), while the other person uses only the arm loops (as in FIG. 39) or uses only the harness (as the person on the left in FIG. 40 does by stowing the arm loops, or by removing the arm loops). Therefore, the many ways of wearing/using the preferred lifter system illustrate the versatility of the lifter system, as each person participating in lifting/maneuvering the object may select the portions of the system and the methods of using said portions according to his/her own stature, strength, and preferences, and/or according to the object to be lifted and the lifting environment and difficulty.

Figures 41A, 41B, 41C:
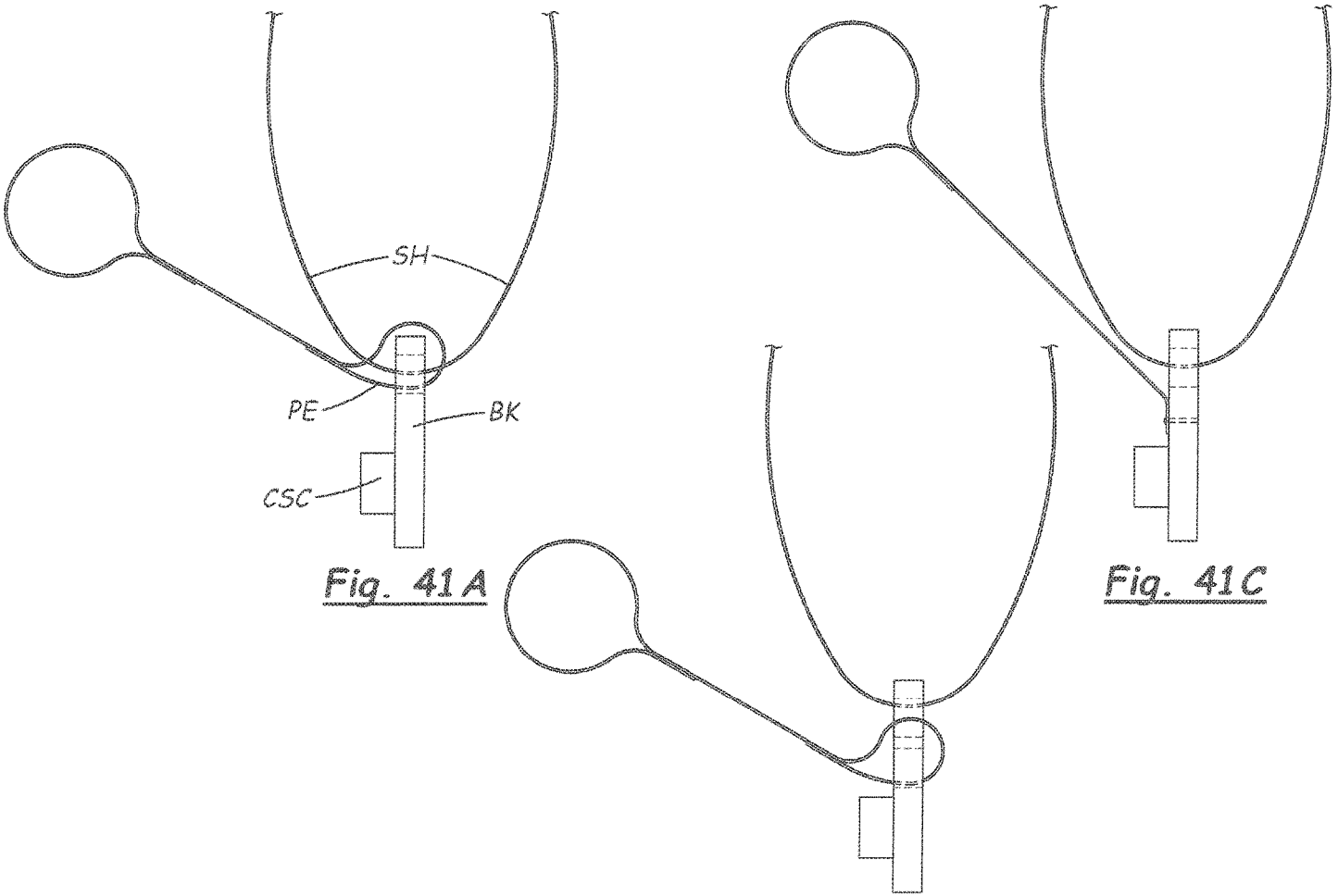
FIG. 41A-41F are schematic side views illustrating various ways to connect an arm loop to a buckle and/or shoulder harness, wherein the arm loop is connected generally or entirely outside a shoulder loop of the harness, including connection to the outside surface of a shoulder loop.
Figures 41D, 41E, 41F:
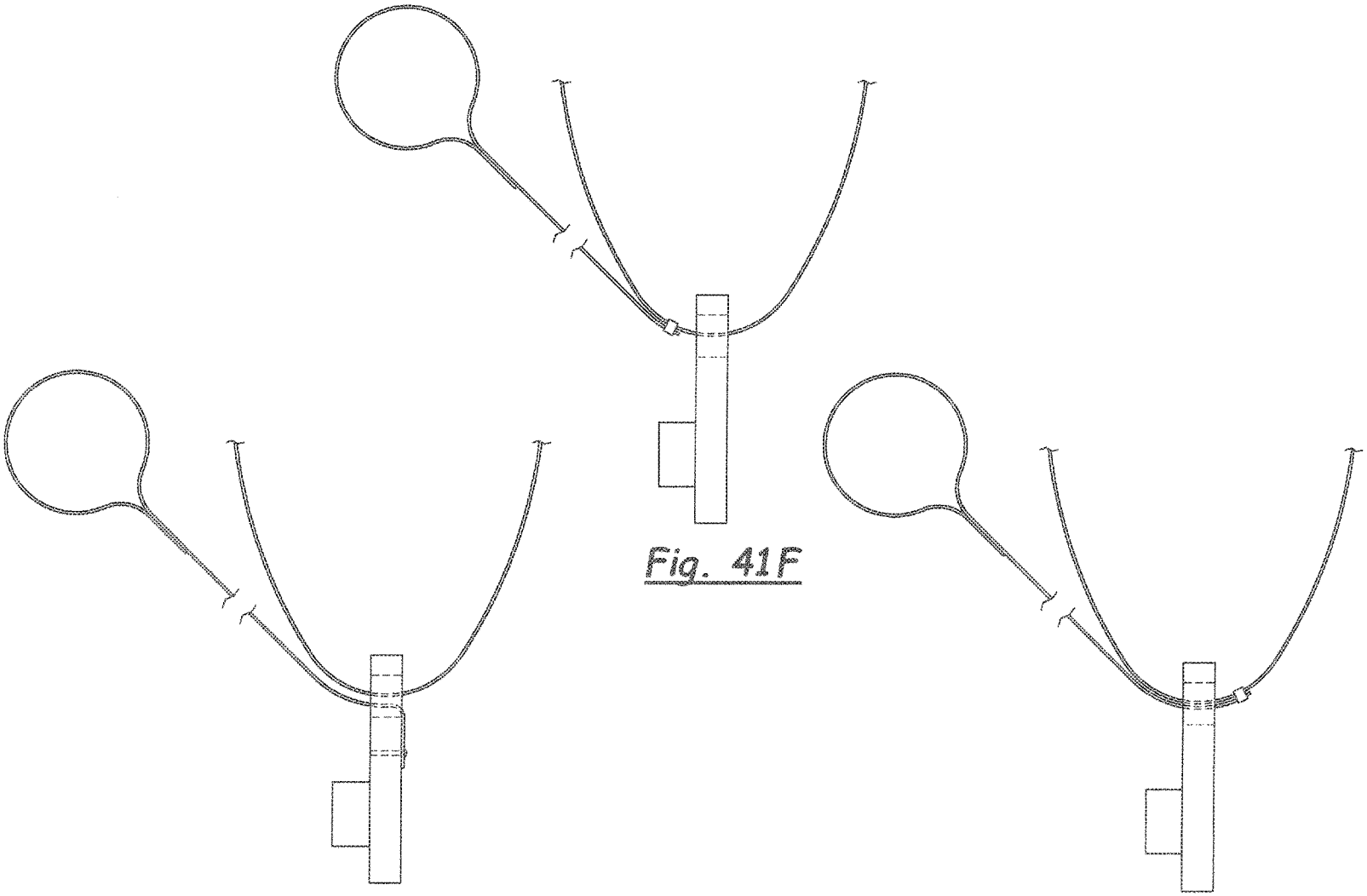

FIGS. 41A through 41F schematically illustrate that, in certain embodiments, arm loops may be connected at many locations on or near the buckle of a lifter system that are generally or entirely outside of the shoulder loops. Subsets of such connections may comprise the arm loop proximal end PE encircling or passing through various portions of the buckle BK and/or of the harness/shoulder loop SH, and/or being attached to the buckle outside of the harness/shoulder loop SH and preferably above the central lifter strap connection CSC, and/or being attached to an outer surface of the harness/shoulder loop SH. FIG. 41A illustrates the proximal end passing through the buckle aperture below and outside the shoulder loop. FIG. 41B illustrates the proximal end passing through a buckle aperture that is below and separate from the shoulder loop aperture. FIG. 41C illustrates fixing the proximal end to the front surface of the buckle below/outside the shoulder loop. FIG. 41D illustrates the proximal end passing through the shoulder loop aperture, below/outside the shoulder loop, and being fixed to the rear surface of the buckle. FIG. 41E illustrates the proximal end passing through the shoulder loop aperture, below/outside the shoulder loop, and being fixed to the shoulder strap behind the buckle. FIG. 41F illustrates the proximal end being fixed to the shoulder strap in front of the buckle.

Figure 42C:
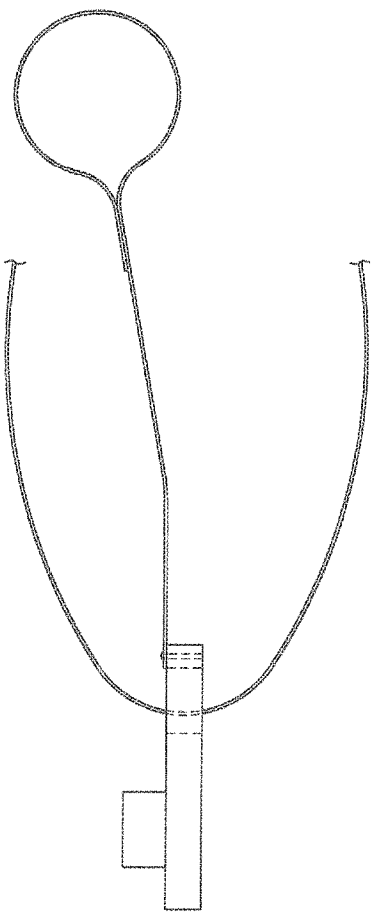
FIGS. 42A-42F are schematic side views illustrating various ways to connect an arm loop to a buckle and/or shoulder harness, wherein the arm loop is connected to the buckle and/or shoulder harness generally or entirely inside a shoulder loop, including connection to the inside surface of a shoulder loop.
Figure 42B:
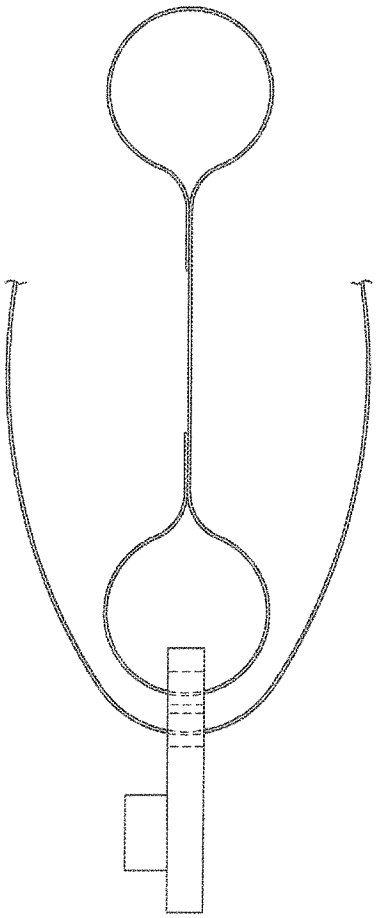
Figure 42A:
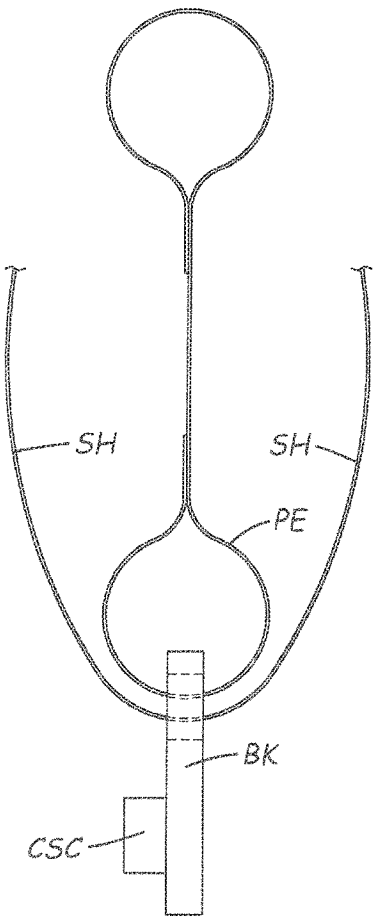
Figure 42F:
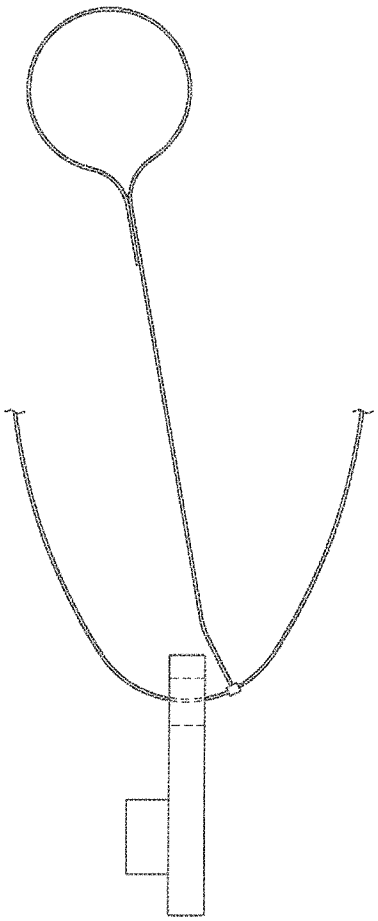
Figure 42E:
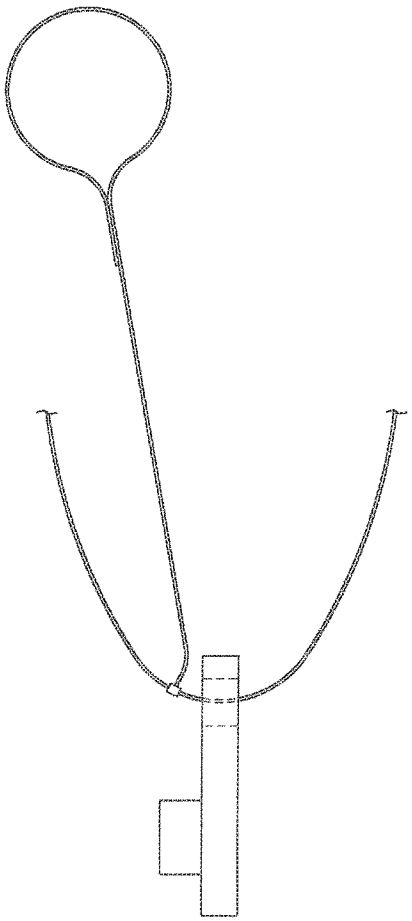
Figure 42D:
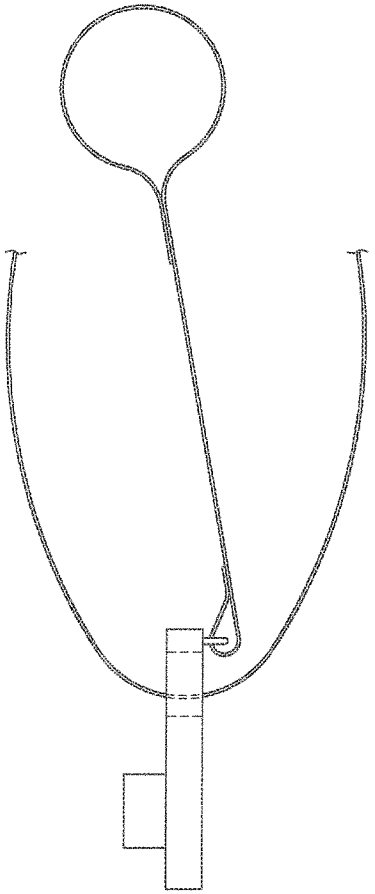

FIGS. 42A-F schematically illustrate that, in certain embodiments, arm loops may be connected at many locations on or near the buckle of a lifter system that are generally or entirely inside of a shoulder loop. Subsets of such connections may comprise the arm loop proximal end PE encircling or passing through various portions of the buckle BK and/or of the harness/shoulder loop SH, and/or being attached to the buckle inside of the harness/shoulder loop SH and preferably above the central lifter strap connection CSC, and/or being attached to an inside surface of the harness/shoulder loop SH. FIG. 42A illustrates the proximal end passing through the shoulder loop aperture of the buckle, above and inside the shoulder loop. FIG. 42B illustrates the proximal end passing through a buckle aperture that is above and separate from the shoulder strap aperture. FIG. 42C illustrates the proximal end being fixed to the front surface of the buckle, above and inside the shoulder loop. FIG. 42D illustrates the proximal end being fixed to a rear surface of the buckle, above and inside the shoulder loop. FIG. 42E illustrates the proximal end being fixed to an inside surface of the shoulder loop in front of the buckle. FIG. 42F illustrates the proximal end being fixed to an inside surface of the shoulder loop behind the buckle.

It will be understood from the description elsewhere in this document, that, from the various connections portrayed in schematic FIGS. 41A-F and schematic FIGS. 42A-F, the arm loop will extend outside and/or away from the shoulder loop and away from the buckle, to place the distal end of the arm loop at the desired distance from the shoulder loop and buckle. Also, it will be understood that various stitching, rivets, hooks, ties, clips, or other fasteners may be used for reliable attachment, and optionally easy detachment, of the proximal end strap to itself to form a proximal aperture, and/or of the proximal end strap to the buckle, and/or of the proximal end strap to the shoulder loop/strap.

From multiple of the Figures and the description above, it will be apparent that the relative positions of each user's buckle, and the arm loops, the connection of arm loops to the buckle or to the harness near the buckle, and the position of the buckle on the user's body, are important in preferred embodiments for optimal operation, versatility, and safety. The lower end or "lowermost extremity" of the front portions of the harness, and the buckle, are preferably at or near, and centered on/against, or directly in front of, the lower belly/torso, so that the preferred single buckle, the central lifter strap, and the arm loop connections to the buckle are also at or near, and centered on/against, or in front of, the lower belly/torso. This translates to said preferred single buckle, central lifter strap, and arm loop connections being also at or near, and centered on/against, of directly in front of, the front lower region of the harness, half way or about half way between the right and left extremities of the harness. It is also important in many embodiments that the arm loops attach to the buckle, or to the harness or slightly above the buckle, with the preferred attachment being at the buckle or at most 3 inches above the buckle. Thus, in many embodiments, the arm loops are not attached to the harness on the rear portions of the shoulder loops, that is, not attached to the harness below, and not below and behind, the buckle. In less preferred embodiments, the arm loops may be attached to the shoulder loops behind the buckle, but, as shown in FIGS. 41E and 42F for example, it is desirable to have the arm loops attachment close to the buckle, for example, 5 inches or less, 3 inches or less, and most preferably 2 inches or less from the back surface of the buckle. The arm loops are also preferably not attached directly to the central lifting strap or any lifting strap that contacts the lifted object.

The preferred placement, attachment, and length, of the arm loops as discussed herein has been found to be surprisingly beneficial and effective for operation, stability, controllability, and safety. For example, the preferred placement and attachment of the arm loops has been found to be a significant improvement compared to any arm loop system that attaches 1) significantly right or left of front-center on a harness, and/or 2) below the point of attachment of a lifting strap to the harness, and/or 3) directly to a lifting strap extending around/underneath or otherwise directly contacting the lifted object. In many embodiments, it is has been found that attaching both arm loops to the same, single buckle, or within about 5 inches or less, preferably within 3 inches or less, and most preferably within 2 inches or less, from the buckle, are examples of the arm loops being operatively connected to the buckle, for surprisingly beneficial and effective operation, stability, controllability, and safety, especially when compared to any arm loop system that attaches arm loops to right or left portions of a harness at right and left connection points that are distanced from each other more than 6 inches. In many embodiments, it is especially desirable that the harness straps are secured, stable, and substantially non-moveable (or entirely non-moveable) relative to the buckle except by flexing of the harness straps. In many embodiments, it is has been found that attaching both arm loops to the same, single buckle, or to the harness at connections points that are at most 6 inches, at most 5 inches, or at most 4 inches, from each other during the entire operation and use of the device, is especially beneficial. For example, if the arm loops are attached to the buckle at or near the right and left extremities of the buckle, the arm loops at the buckle are distanced, at their connections to the buckle, at most a distance equal to the width of the buckle. For example, if the buckle is at most 6 inches wide, 5 inches wide, or 4 inches wide, the arm loops, at their connections to the buckle, will be at most 6 inches, 5 inches, or 4 inches, apart, respectively. One may understand that such locations, which are at most 6 inches apart, differ greatly from a system wherein arm loops are connected to a harness or lifting straps at the right and left sides of a user, which would equate to at least 12 inches apart, at least 18 inches apart, or at least 24 inches apart, for most adult-sized lifting systems. It is also important in many embodiments that the arm loops length be short enough, or adjustable to be short enough, to lift the buckle up from its original level when hanging from the harness when the arm loops are slack. A workable general rule is to make or adjust the arm loops to be at least 20 percent, and more preferably at least 30 percent, and most preferably 30-70 percent, shorter than the length of the harness, measured from the uppermost extremity of the harness to the buckle of the harness.

Certain embodiments of the lifter system for being worn by a user to lift an object may be described as comprising, consisting essentially of, or consisting of: a harness for encircling at least part of a torso of the user; a buckle connected to the harness at a central portion of the harness that is for placement at or near a lower, central region of the torso; a central lifter strap connected to the buckle for extending away from the buckle and underneath the object; right and left arm loops, each comprising an arm aperture for receiving right and left arms of the user, respectively, the arm loops being operatively connected to the buckle to lift the buckle and the central lifter strap upward when the user lifts the right and left arms. The arm loops may be operatively connected to the buckle by a connection selected from attachment to the buckle, and attachment to the harness at or near to the buckle, and attachment to the harness is at a location on the harness that is above the buckle within 5 inches of a top-most extremity of the buckle, for example. The harness may comprise a right and a left shoulder loop and said central position on the harness may be a region of the harness centered between right and left extremities of the right and left shoulder loops, respectively. The harness may comprise a loose waist belt, and said central position on the harness may be a region of said waist belt that is centered half way between right and left extremities of the waist belt. Certain embodiments comprise only one buckle, and only one central lifter strap, and, in certain embodiments, each right and left arm loops has only one of said arm apertures, which may be adjustable in diameter. The right and left arm loops each have a length that may be adjustable. The preferred buckle may be at most 6 inches wide, and an arm loop lowermost end of each arm loop connects to the buckle, so that the lowermost ends of the arm loops are at most 6 inches apart horizontally. The harness has a length from an uppermost extremity of the harness to the buckle, and each of the arm loops is preferably shorter in length than said length of the harness, for example, 30-70 percent shorter in length than said length of the harness. Various buckles may be used, but preferred buckles are selected from a group consisting of: a sliding-bar-buckle with a sliding bar that captures the central lifter strap against another portion of the sliding-bar-buckle, and a flexible-loop-buckle with a loop that flexes to capture the central lifter strap against another portion of the flexible-loop-buckle.

Certain embodiments of the invention comprise providing a lifter system according to any of the embodiments described herein and performing method steps that result in lifting an object. For example, a method may comprise: providing a lifter system as described herein to two users, wherein each user chooses to wear in operative position one or more portions of the system (harness and arm loops); installing opposite ends of the central lifter strap in the two central buckles of the lifter system (one per user), and placing the central lifter strap under the object; adjusting, before or after said placing, the central lifter strap to be a length that makes it taut when the users are bending or crouching part way down to the ground; the users then standing up straight, which lifts the buckle, central lifter strap and the object off the ground (to the "original" level for the buckle, central lifter strap, and object); and, optionally, said one or both users further lifting their arms, if arm loops are worn by said one or both users, to pull the buckle, and hence the central lifter strap, and the object even higher than said original level.

Therefore, one may understand that certain embodiments of the lifter system may include many combinations: two people wearing a harness and arm loops; two people wearing only arm loops on their arms, and not wearing the harness; one person wearing a harness but not the arm loops, and the other person only wearing the arm loops, and one person wearing a harness and also arm loops and the other person wearing only arm loops.

Although this disclosed technology has been described above with reference to particular means, materials, and embodiments, it is to be understood that the disclosed technology is not limited to these disclosed particulars, but extends instead to all equivalents within the scope of this disclosure including the drawings and the following claims.

The invention claimed is:

1. A lifter system for being worn by a user to lift an object, the system comprising:

a harness for encircling at least part of a torso of the user, the harness comprising a right shoulder loop and a left shoulder loop each having an upper portion for lying over a shoulder of the user and each having a lower end;

the harness having a lower central portion, centered between right and left extremities of the right and left shoulder loops, respectively, that is for placement at or near a lower central region of the torso, the lower central portion comprising the lower ends of the right and left shoulder loops, and a buckle connected to the lower ends of the right and left shoulder loops;

a central lifter strap connected to the buckle for extending away from the buckle and underneath the object; and right and left arm loops, each extending from said lower central portion, having a proximal end attached to the buckle or attached to the harness at or near the buckle, and having a distal end comprising an arm aperture for receiving forearms of right and left arms of the user, respectively, the arm loops being configured to lift the buckle, the lower ends of the right and left shoulder loops, and the central lifter strap upward when the user lifts the distal ends of the arm loops by lifting the right and left forearms received in the arm apertures.

2. The lifter system as in claim 1 that comprises only one buckle, and only one central lifter strap.

3. The lifter system as in claim 1, wherein each of the right and left arm loops has only one of said arm apertures.

4. The lifter system as in claim 3, wherein said one arm aperture of each right and left arm loop has an adjustable diameter.

5. The lifter system as in claim 3, wherein the right and left arm loops each have a length that is adjustable.

6. The lifter system as in claim 1, wherein the buckle is at most 6 inches wide, and wherein said proximal ends of the right and left arm loops are at most 6 inches apart horizontally.

7. The lifter system as in claim 1, wherein the harness has a length from an uppermost extremity of the harness to the buckle, and each of the arm loops is 30-70 percent shorter in length than said length of the harness.

8. The lifter system as in claim 1, wherein the buckle is selected from a group consisting of: a sliding-bar-buckle with a sliding bar that captures the central lifter strap against another portion of the sliding-bar-buckle, and a flexible-loop-buckle with a loop that flexes to capture the central lifter strap against another portion of the flexible-loop-buckle.

9. A lifter system for being worn by a user to lift an object, the system consisting essentially of:

a harness for encircling at least a portion of a torso of the user, comprising a right shoulder loop and a left shoulder loop each having an upper portion for lying over a shoulder of the user and each having a lower end;

the harness having a lower central portion, centered between right and left extremities of the right and left shoulder loops, respectively, that is for placement at or near a lower central region of the torso, the lower central portion comprising the lower ends of the right and left shoulder loops, and a single central buckle connected to the lower ends of the right and left shoulder loops;

a single central lifter strap connected to the central buckle and extending away from the central buckle and underneath the object; and right and left arm loops, each extending from said lower central portion, having a proximal end attached to the central buckle or attached to the harness at or near the central buckle, and having a distal end comprising a single arm aperture for receiving right and left forearms of the user, respectively, the arm loops being operatively connected to the central buckle to lift the central buckle, the lower ends of the right and left shoulder loops, and the central lifter strap upward when the user lifts the right and left forearms received in the arm apertures.

10. The lifter system as in claim 9, wherein the arm loops being operatively connected to the central buckle comprises a connection selected from the group consisting of: attachment to the central buckle, attachment to the harness at or near to the central buckle; and attachment to the harness is at a location on the harness that is above the central buckle within 5 inches of a top-most extremity of the central buckle.

11. The lifter system as in claim 9, wherein said one arm aperture of each right and left arm loop has an adjustable diameter; and the right and left arm loops each have a length that is adjustable.

12. The lifter system as in claim 9, wherein the central buckle is at most 6 inches wide, and wherein the proximal ends of the arm loops are at most 6 inches apart horizontally.

13. The lifter system as in claim 9, wherein the harness has a length from an uppermost extremity of the harness to the central buckle, and each of the arm loops is 30-70 percent shorter in length than said length of the harness.

14. A lifter system for being worn by a user to lift an object, the system comprising:

a harness for encircling at least part of a torso of the user, the harness comprising a right shoulder loop and a left shoulder loop each having an upper portion for lying over a shoulder of the user and each having a lower end;

the harness having a lower central portion, centered between right and left extremities of the right and left shoulder loops, respectively, that is for placement at or near a lower central region of the torso, the lower central portion comprising the lower ends of the right and left shoulder loops, and a buckle connected to the lower ends of the right and left shoulder loops;

a central lifter strap connected to the buckle and extending away from the buckle, for being placed underneath the object; and right and left arm loops operatively connected to the lower central portion of the harness and each of the right and left arm loops having a distal end comprising an arm aperture for receiving arms of right and left arms of the user, respectively, the arm loops being configured to lift the buckle, the lower ends of the right and left shoulder loops, and the central lifter strap upward when the user lifts the distal ends of the arm loops by lifting the right and left arms received in the arm apertures.

15. The lifter system as in claim 14, wherein the right and left arm loops are operatively connected to the lower central portion of the harness by being attached to the buckle or on the harness 0-5 inches above a top end of the buckle.

* * * * *